US012588715B2

(12) United States Patent
Bassoo et al.

(10) Patent No.: US 12,588,715 B2
(45) Date of Patent: Mar. 31, 2026

(54) MULTI-FUNCTIONAL VEST WITH INTEGRATED WEIGHT AND HYDRATION FEATURES

(71) Applicants: Naipaul Bassoo, North York (CA); Jainarine Bassoo, North York (CA)

(72) Inventors: Naipaul Bassoo, North York (CA); Jainarine Bassoo, North York (CA)

( * ) Notice: Subject to any disclaimer, the term of this patent is extended or adjusted under 35 U.S.C. 154(b) by 0 days.

(21) Appl. No.: 18/813,198

(22) Filed: Aug. 23, 2024

(65) Prior Publication Data

US 2025/0089822 A1 Mar. 20, 2025

Related U.S. Application Data

(63) Continuation-in-part of application No. 17/970,401, filed on Oct. 20, 2022, now abandoned, which is a (Continued)

(51) Int. Cl.
*A41D 1/04* (2006.01)
*A63B 21/00* (2006.01)
(Continued)

(52) U.S. Cl.
CPC ..... *A41D 1/04* (2013.01); *A63B 21/0557* (2013.01); *A63B 21/065* (2013.01); *A63B 21/4007* (2015.10); *A63B 2225/605* (2013.01)

(58) Field of Classification Search
CPC .. A41D 1/04; A63B 21/0088; A63B 21/0552; A63B 21/065; A63B 21/4007;
(Continued)

(56) References Cited

U.S. PATENT DOCUMENTS 4,344,620 A 8/1982 Debski
4,602,387 A 7/1986 Zakrzewski
(Continued)

FOREIGN PATENT DOCUMENTS

AU 2017100383 5/2017
CN 105209251 12/2015
(Continued)

OTHER PUBLICATIONS

2XSR, product title: Training Vest, product listing on website (online): https://www.2xsr.com/products/training-vest, published Jul. 5, 2021.

(Continued)

*Primary Examiner* — Joshua Lee

(57) ABSTRACT

The present invention pertains to a multifunctional-vest apparatus comprising a front panel and a rear panel, interconnected via a pair of adjustable fasteners to provide a secure and customizable fit for a user. The rear panel is equipped with a compartment for weights and a hydration feature. The vest further includes a set of shoulder straps, wherein at least one shoulder strap configured to secure components, such as a hydration tube, thereby enabling convenient access to hydration during use. This vest apparatus is particularly suited for enhancing a user for different weight increments for resistance training while staying hydrated.

20 Claims, 16 Drawing Sheets

Related U.S. Application Data continuation-in-part of application No. PCT/IB2021/053223, filed on Apr. 20, 2021, which is a continuation of application No. 16/852,880, filed on Apr. 20, 2020, now abandoned.

(60) Provisional application No. 63/129,481, filed on Dec. 22, 2020, provisional application No. 62/869,476, filed on Jul. 1, 2019.

(51) Int. Cl.
*A63B 21/055* (2006.01)
*A63B 21/065* (2006.01)

(58) Field of Classification Search
CPC ..... A63B 2209/10; A63B 2225/09; A63B 2225/605; A63B 2225/682; B63C 9/115
See application file for complete search history.

(56) References Cited

U.S. PATENT DOCUMENTS

| | | | | |
|---|---|---|---|---|
| 5,002,270 | A * | 3/1991 | Shine | A63B 21/065 2/102 |
| 5,617,582 | A * | 4/1997 | Burwell | A41D 13/0012 2/119 |
| 6,081,924 | A * | 7/2000 | Ott | A63B 21/065 2/102 |
| 6,665,879 | B2 | 12/2003 | VandenBerg | |
| 6,669,608 | B1 * | 12/2003 | Winston | A63B 21/4007 2/102 |
| 6,675,391 | B2 * | 1/2004 | Morrison | A63B 21/065 2/102 |
| 6,691,318 | B1 * | 2/2004 | Davis | A63B 21/0004 2/102 |
| 7,565,705 | B2 | 7/2009 | Elkins et al. | |
| 7,707,652 | B2 * | 5/2010 | Senegal | A63B 23/047 2/102 |
| 8,156,572 | B2 | 4/2012 | Whaley | |
| 8,262,545 | B1 * | 9/2012 | Beber | A63B 21/065 224/264 |
| 8,490,212 | B1 * | 7/2013 | Asher | A41D 1/04 2/2.5 |
| 8,595,862 | B2 * | 12/2013 | Storms, Jr. | A41D 13/05 2/2.5 |
| 9,173,473 | B2 * | 11/2015 | Gleason | A45F 5/00 |
| 9,265,318 | B1 | 2/2016 | Williams | |
| 9,737,100 | B2 * | 8/2017 | McIntire, Jr. | A41D 15/04 |
| 10,286,249 | B1 * | 5/2019 | Sibhatu | A63B 21/0552 |
| 10,951,865 | B2 | 3/2021 | Thiel et al. | |
| 11,304,500 | B2 * | 4/2022 | Thiel | A45F 3/047 |
| 11,684,140 | B2 | 6/2023 | Hassett et al. | |
| 2005/0096199 | A1 * | 5/2005 | Egbert | A63B 21/0602 482/105 |
| 2007/0083975 | A1 * | 4/2007 | Senegal | A63B 21/4017 2/102 |
| 2007/0289045 | A1 * | 12/2007 | Evans | A45F 3/06 2/102 |
| 2008/0067202 | A1 | 3/2008 | Silva et al. | |
| 2011/0004968 | A1 * | 1/2011 | Morgan | B63C 9/135 2/2.5 |
| 2012/0017347 | A1 * | 1/2012 | Strum | A41D 13/0007 24/3.1 |
| 2014/0338095 | A1 | 11/2014 | Storms, Jr. et al. | |
| 2015/0342329 | A1 * | 12/2015 | Formosa | A41D 13/0012 2/102 |
| 2015/0374043 | A1 * | 12/2015 | Dahl | A41D 1/04 2/102 |
| 2015/0374045 | A1 | 12/2015 | Codner et al. | |
| 2016/0033235 | A1 | 2/2016 | Kinnings | |
| 2016/0367848 | A1 * | 12/2016 | Seuk | A63B 21/00065 |
| 2017/0231371 | A1 | 8/2017 | Li et al. | |
| 2018/0161615 | A1 * | 6/2018 | Feng | A63B 21/065 |
| 2019/0133303 | A1 * | 5/2019 | Thiel | A41D 27/201 |
| 2020/0281284 | A1 | 9/2020 | Mcallister et al. | |
| 2020/0288089 | A1 | 9/2020 | Thiel et al. | |
| 2023/0346112 | A1 | 11/2023 | O'Brien | |
| 2024/0128526 | A1 | 4/2024 | Thiel et al. | |
| 2024/0422296 | A1 | 12/2024 | Thiel et al. | |

FOREIGN PATENT DOCUMENTS

| | | |
|---|---|---|
| CN | 111426235 | 7/2020 |
| CN | 308999609 | 12/2024 |
| EM | 2931079 | 9/2020 |
| WO | 2013082173 | 6/2013 |
| WO | 2014096797 | 6/2014 |
| WO | 2018217421 | 11/2018 |
| WO | 2020036643 | 2/2020 |

OTHER PUBLICATIONS

Intensity Performance, product title: 2XSR Training Vest, Instagram post (online): https://www.instagram.com/p/CQBevd8BYEM/?igsh=MWUwNXV4cm51dm10aA == Disclosed on Jun. 12, 2021.

Qore Performance, product title: IMS Versa Gen 3 Combo (MOLLE Plate Carrier Hydration Pouch with Cooling and Heating) product listing on webstite (online): https://www.qoreperformance.com/collections/molle-sleeves/products/ims-versa-combo published: May 15, 2023.

Qore Performance, product titled: ICEPLATE® Hydration Backpack Gen 3 Blem (Regen), product listing on website (online): https://www.qoreperformance.com/products/iceplate-hydration-backpack-gen-3-seconds-regen ?_ pos=1&_sid=fe2df1b50&_ss=r&variant=43943758430323 published: 2016.

Weighted Vest, product title: Hydration Pack 1.5L, product listing on website (online): https://www.weightvest.com/product/hydration-pack-1-5-liter/ published: as early as 1983.

Seiberton, product title: Tactical Molle Hydration Carrier Pack, product listing on Amazon (online): https://www.amazon.ca/Seibertron-Tactical-Hydration-Backpack-Motorcycle/dp/B078KTKW4X/ref=asc_df_B078KTKW4X/?tag=googleshopc0c-20&linkCode=df0&hvadid=706747096228&hvpos=&hvnetw=g&hvrand=270851669603691959 2&h vpone=&hvptwo=&hvqmt=&hvdev=c&hvdvcmdl=&hvlocint=&hvlocphy=9000910&hvtargid=pla-466873396308&mcid=205a8db0144634af92a1afffb7d864b7&gad_source=1&th=1 published: Dec. 17, 2016.

Cruiage Industry, product title: USA Original Patent Running Hydration Vest Backpack, Lightweight Chest Pack with 2.0L Water Bladder Bag Daypack for Hiking Running Cycling Race Marathon for Women Men, product listing on Amazon (online): https://www.amazon.com/Criuage-Original-Hydration-Backpack-Lightweight/dp/B0DCG252NR/ref=sr_1_1_sspa?crid=29MKFMTF276LI&dib=eyJ2IjoiMSJ9.g2oia1uovJz0S9hu2icg8xb76jutpfPwoi2RH7LLbtqiXmlj33WokTXj7eQgleAvqnJbqeRhVYOv1Fp1VGpH9QjYr5Q3gISG.

Votagoo Gear, product title: Lightweight Running Hydration Vest Backpack with 2L Water Bladder Bag Daypack for Hiking, Cycling, Hunting and Climbing for Women Men, product listing on Amazon (online): https://www.amazon.com/VOTAGOO-Lightweight-Hydration-Backpack-Climbing/dp/B0F7QF9BGC/ref=pd_rhf_se_s_pd_sbs_rvi_d_sccl_2_5/147-3538569-0854557?pd_rd_w=oUtLg&content-id=amzn1.sym.6640a844-ab24-4352-ac9b-78899e683a5e&pf_rd_p=6640a844-ab24-4352-.

Woisiaso Store, sold by FTCYCRU Industry, product title: Hydration Vest with 2L Water Bladder for Men andWomen, Lightweight Adjustable Hydration Backpack, Reflective Running Hydration Chest Bag for Hiking Climbing Cycling, product listing on Amazon (online): https://www.amazon.com/Hydration-Lightweight-Adjustable-Backpack-Reflective/dp/B0FF4P4Z7V/ ?_ encoding=UTF8&pd_rd_w=s6tL3&content-id=amzn1.sym.4efc43db-939e-4a80-abaf-50c6a6b8c631%3Aamzn1.symc.5a16118f-86f0-44cd-8e3e-6c5f82df43d0&pf_rd_p=4efc43db-939e-4a80-.

Banloga, product title: Men's Chest Bag with Accordion Structure, Running Vest with Molle System, Chest Bag for Cycling, Hiking, product listing on Amazon Brazil (online): https://www.amazon.

(56) References Cited

OTHER PUBLICATIONS com.br/dp/BOFF42775H?tag=mochila02-20&linkCode=ogi&th=1&keywords=bolsa%2Bcolete%2B(estilo%2Bcolete) published Aug. 19, 2025.
Fittas Pro Store, product title: 2L Bladder Capacity (No Bladder Included) Lightweight Water-Resistant for Running, Hiking, Cycling With Reflective Strips Adjustable Straps product listing on Amazon (online): https://www.amazon.com/dp/BODFM8SSBF published on Jan. 14, 2025.
5.11 TACTICAL, product title: Tactec® Field Bundle, product listing on website (online): https://www.511tactical.com/tactec-field-bundle, published Mar. 23, 2023.
5.11 Tactical, product title: PC Convertible Hydration Carrier, product listing on website (online): https://www.511tactical.com/pc-convertible-hydration-carrier published: Sep. 23, 2021.
Beez Combat System, product title: Hydration backpack short, product listing on website (online): https://www.beezcombatsystems.com/collections/plate-carrier-accessories-1/products/hydration-backpack-short, published on Aug. 17, 2022.
Excellent Elite Spanker, product title: Tactical MOLLE Hydration Pack for 3L Hydration Water Bladder Molle Vest Accessory, product listing on Amazon (online): https://www.amazon.com/EXCELLENT-ELITE-SPANKER-Hydration-Accessory/dp/B073CPYNLX/ref=sr_1_1_sspa?crid=PKEQ54BSEX2H&dib=eyJ2IjoiMSJ9.DcDqEyUB-V-7nFZ39HoDyX2WOIYY1deYWpxXtFHy2Qh4XV90ABsD80LJc3OuXtQOQuogJge0MFm_1bynceBP2vU_IVsVR-kOfHtjv2yAsJliNpgsGp4a_ZBqhy7ixYnhQmkzGIKuaGfzQHL4IS057p0ZOVOhHuFgyLoN5VIS8zdtyNX8uBf-.
Reddit, title of article and/or blog: Hydration on platecarrier, website article and/or blog on website (online): https://www.reddit.com/r/Quality TacticalGear/comments/16efa5e/hydration_on_platecarrier/ published Sep. 13, 2023.
L&Q Army, product title: Tactical Hydration Vest, product listing on website (online): https://www.lqcompany.com/tactical-vest/tactical-hydration-vest/ published Mar. 25, 2025.
L&Q Army, Instagram username: aet_gear, product title: water bag, published on Instagram (online): https://www.instagram.com/p/C1_cVx2ptfX/ published Jan. 12, 2024.
Guangzhou Yzh Skirmish Co,. Ltd product title: Emersongear 500D Cordura Nylon Tactical Grenade Hydration Pouch Vest Back Panel With LXB Style for 420 Tactical Vest, product listing on Ali Baba (online): https://www.alibaba.com/product-detail/Emersongear-500D-Cordura-Nylon-Tactical-Grenade_1600270372119.html?spm=a2700.prosearch.normal_offer.d_image.20e867afVAA13r&priceId=66057a891e0d4058b83c6de663c4579c published Mar. 22, 2019.
Ethos, product title: Ethos Adjustable 20 lb. Plate Loaded Vest, product listing on Dick's Sporting Goods website (online), phttps://www.dickssportinggoods.com/p/ethos-plate-loaded-vest-20au6upltlddvstxxeac/20au6upltlddvstxxeac?color=Black published as early as 2018.
Sh Vietnam, product title: Tactical Plate Carrier, product listing on website (online): https://shvietnam.com/category/tactical/plate-carrier/page/2/, published Oct. 22, 2021.

* cited by examiner

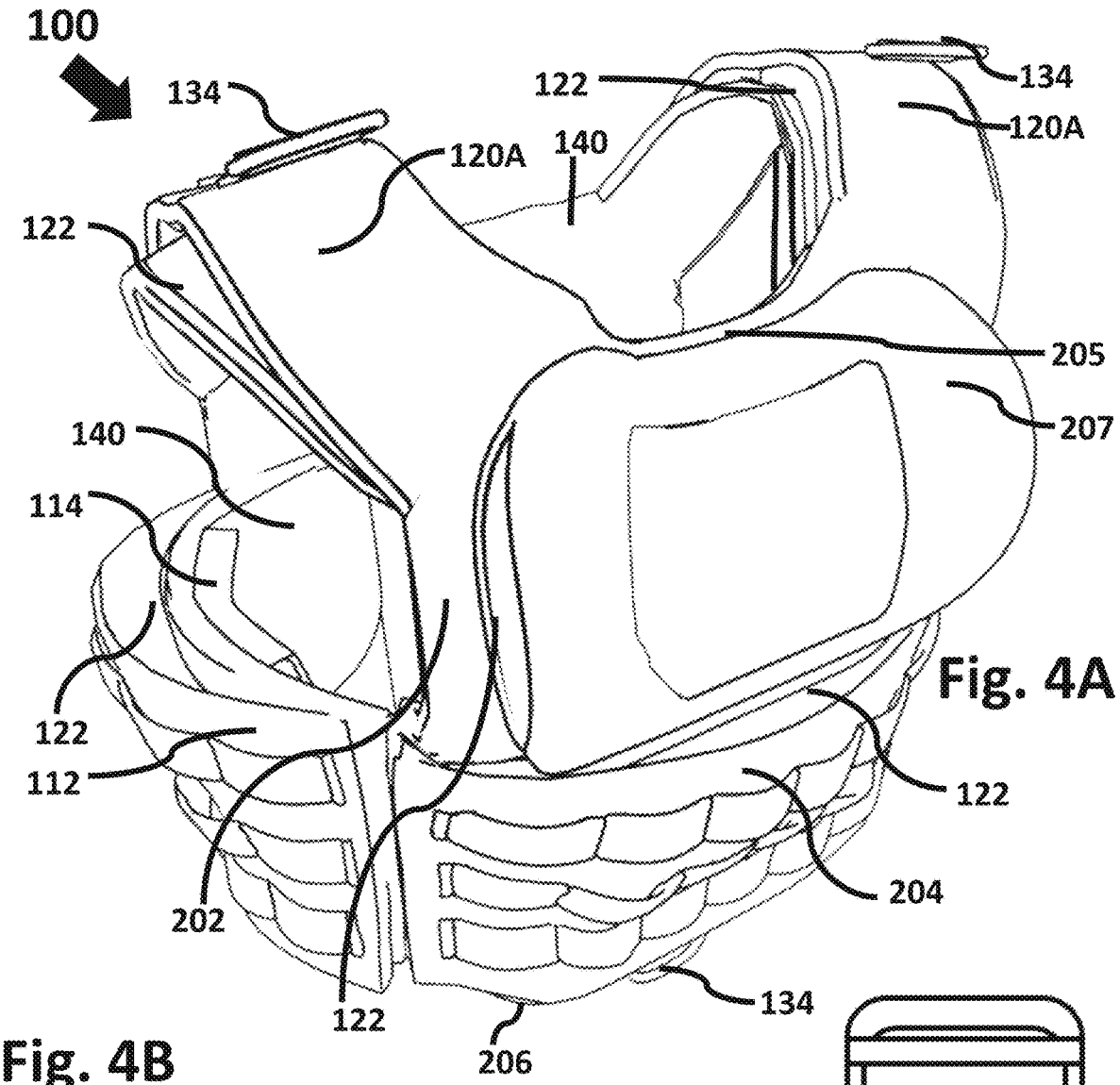
Fig. 4A
Fig. 4B
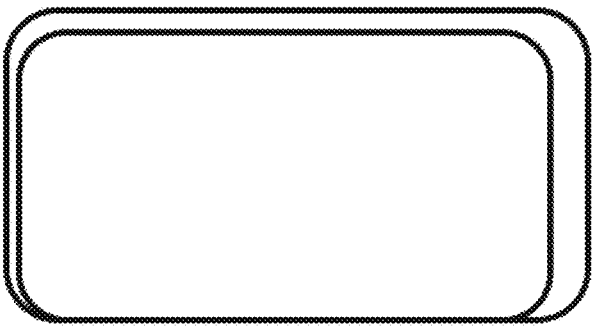
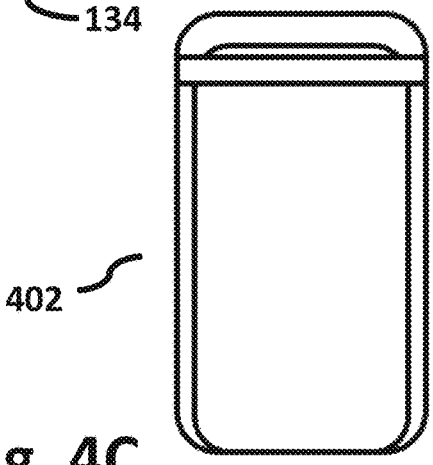
Fig. 4C

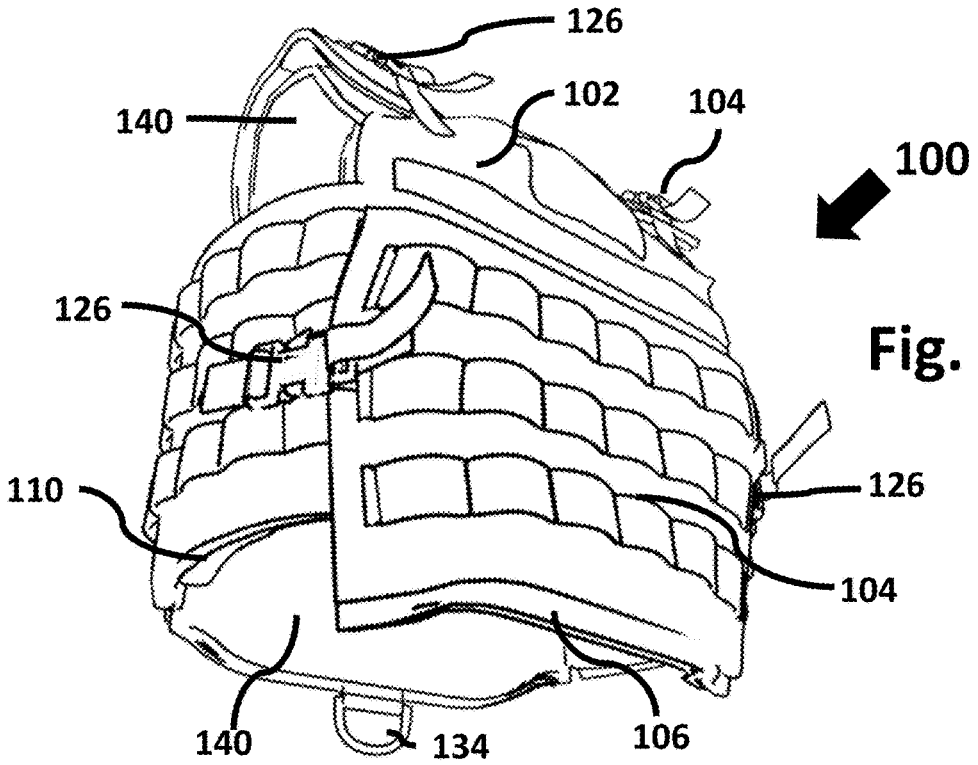
Fig. 5A
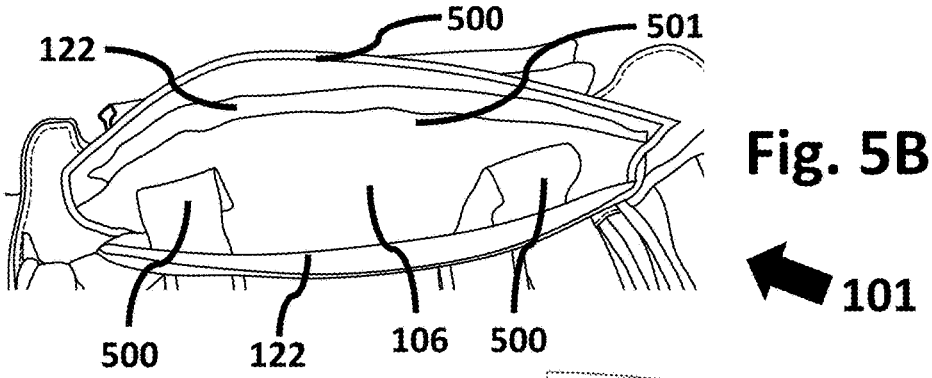
Fig. 5B
Fig. 5C
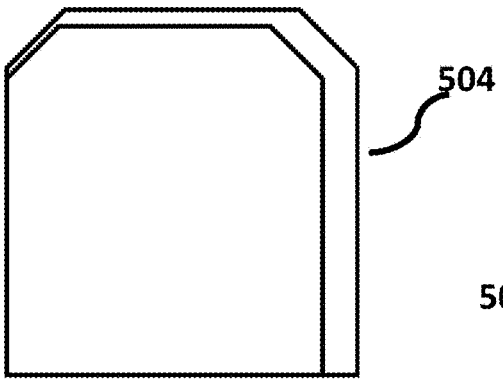
Fig. 5D
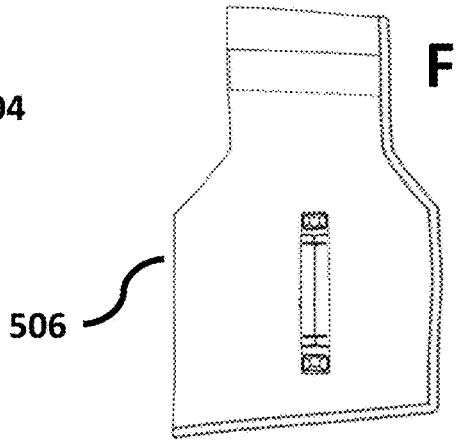

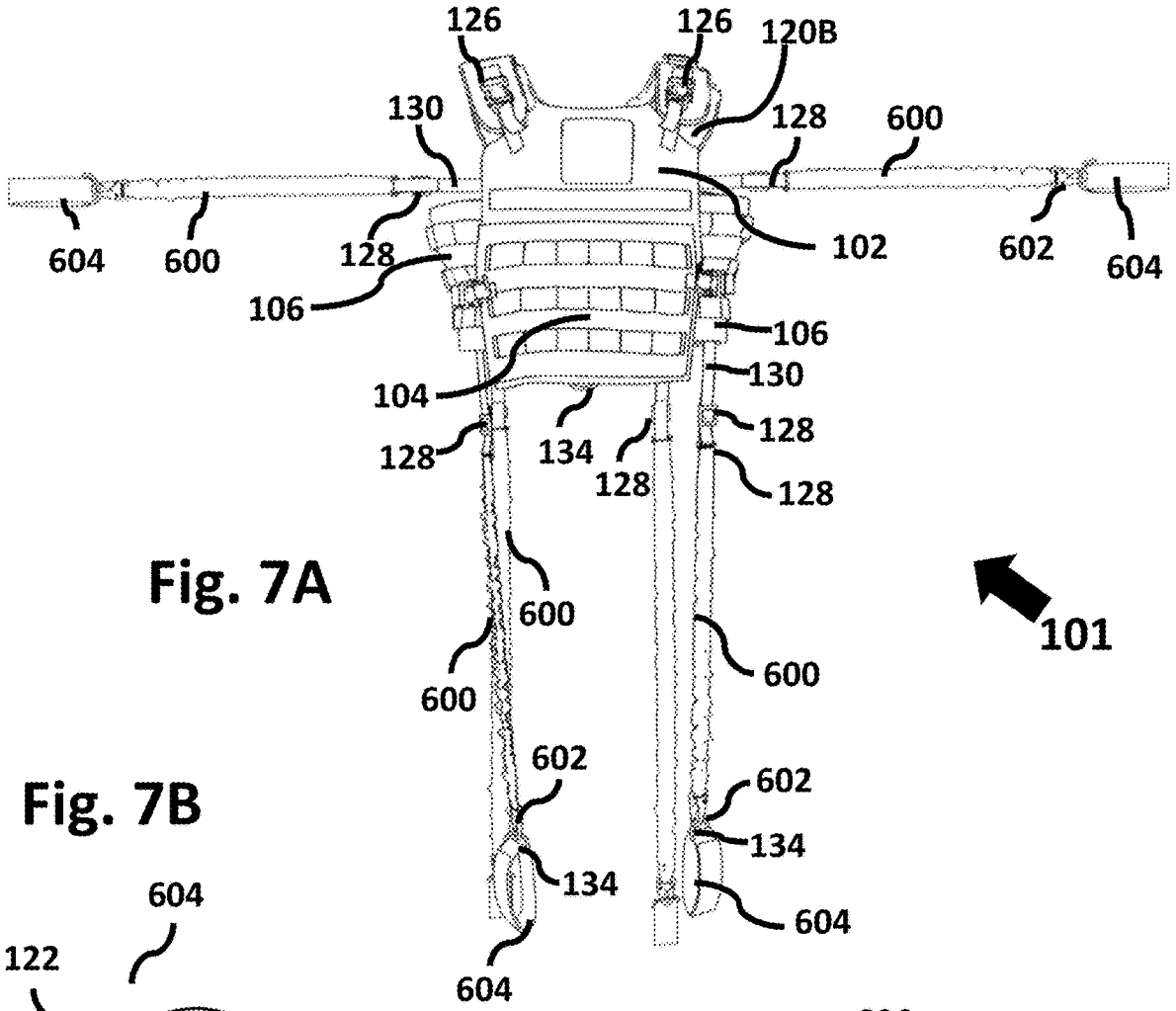
Fig. 7A
Fig. 7B
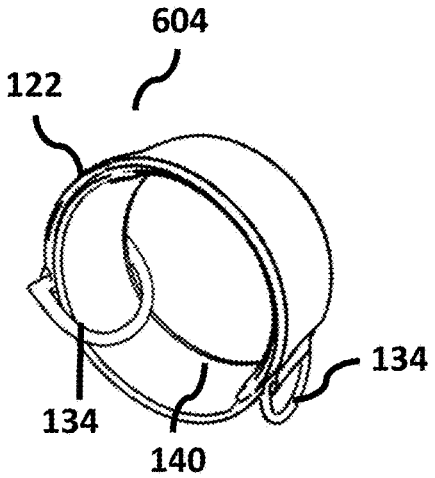
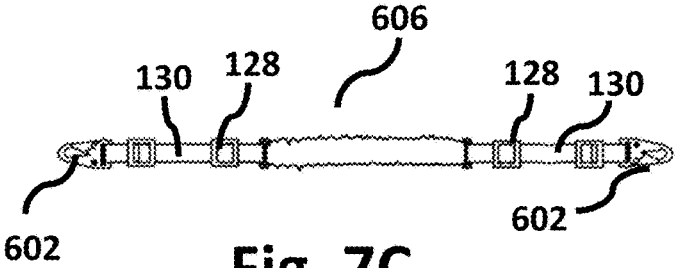
Fig. 7C

Fig. 11A
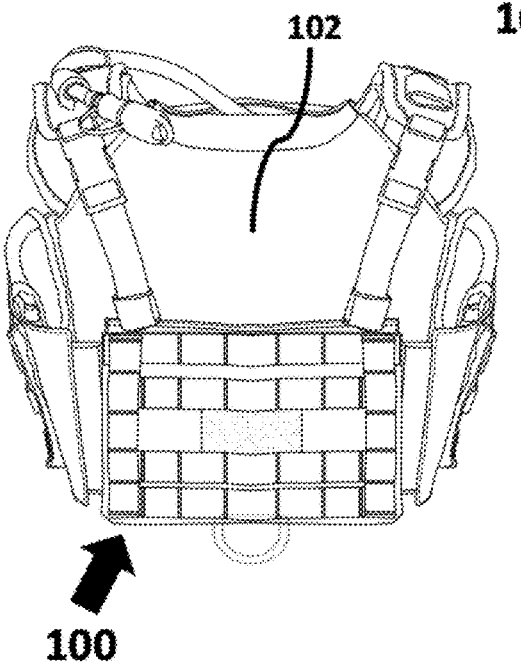
Fig. 11B
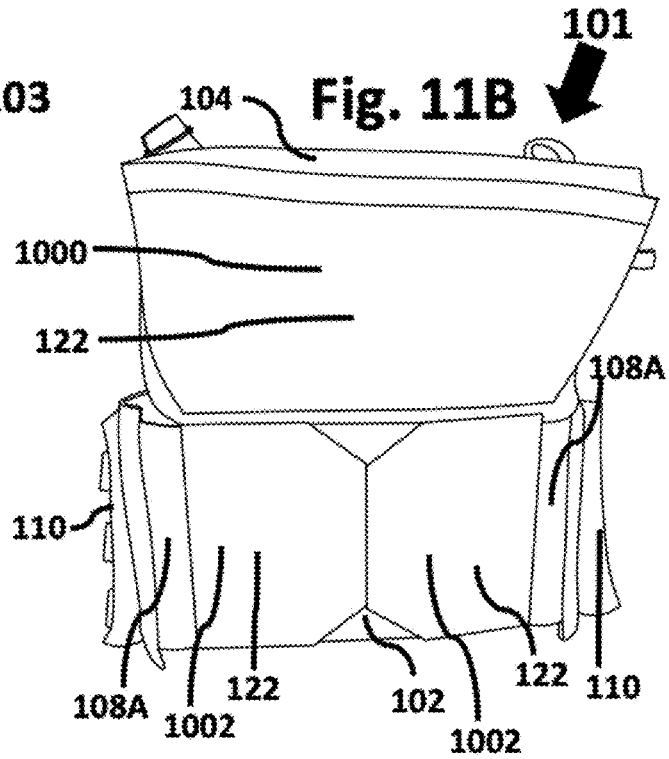
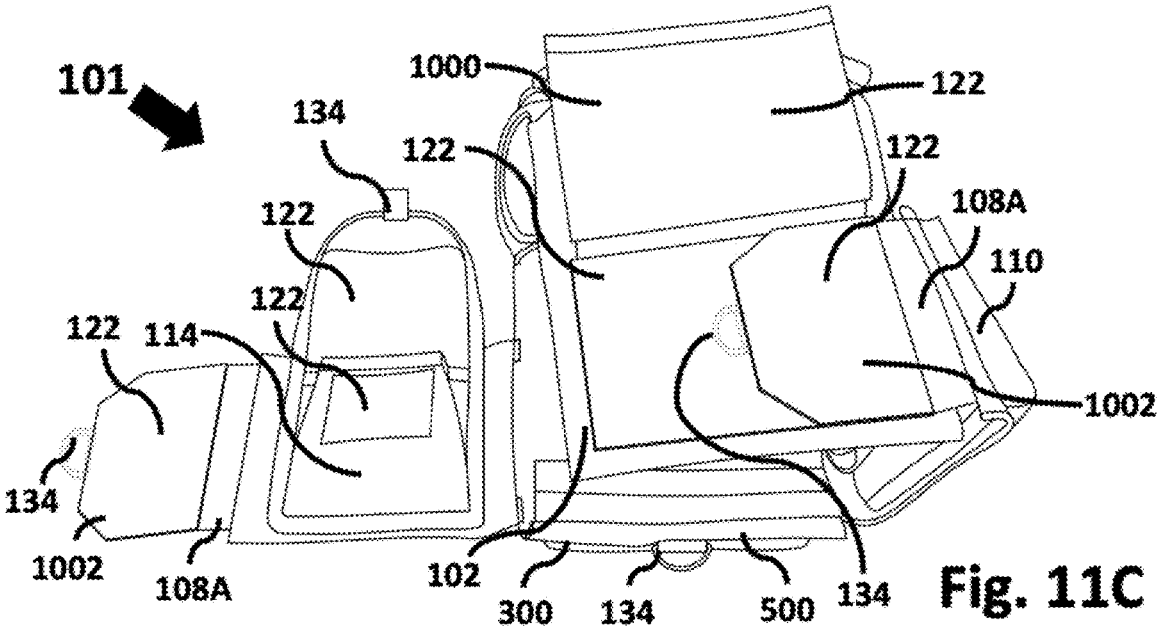
Fig. 11C

MULTI-FUNCTIONAL VEST WITH INTEGRATED WEIGHT AND HYDRATION FEATURES

CROSS REFERENCE

The application is a Continuation in Part of U.S Continuation in Part application Ser. No. 17/970,401 filed on Oct. 20 2022 which is a Continuation of PCT/IB2021/053223 filed on Apr. 20 2021, which is a continuation of U.S. Provisional Application No. 63/129,481 filed on Dec. 22, 2020, and U.S. Non-Provisional application Ser. No. 16/656,840 filed on Apr. 20, 2020 which claims the benefits of U.S. Provisional Patent Application 62/869,476 filed on Jul. 1 2019 all of which prior applications are incorporated by reference herein.

FIELD

This present invention relates to wearable vests designed to carry weight and provide hydration components, particularly to vests that integrate weight-bearing elements and hydration systems for physical activities.

BACKGROUND

Originally vests were designed strictly for weight lifting or for running to hold a fixed dimension weight in certain compartments. This limits the consumer to purchase weighted plates which is costly for manufacturing and shipping. Typically, these vests include a minimal to a few compartments to hold a weight for resistance exercises.

Fitness programs and routines are balanced between strength training and endurance training.

Accordingly, this document generally describes a vest with a set of compartments for weights and adjustable fillable weights with hydration features.

SUMMARY

This summary is provided merely for purposes of summarizing some example embodiments, so as to provide a basic understanding of some aspects of the subject matter described herein.

There is disclosed herein a multi-functional vest apparatus comprising of a set of panels, in particular a front panel, a rear panel and a set of side panels, wherein the set of side panels can be interpreted as a set of waist straps comprises of a set of fasteners and adjustable fasteners to increase to decrease dimensions within the main body of the vest for physical activities.

The assembled closed vest configuration is defined as all panels engaged with each other, in particular the front panel, the rear panel and the set of side panels. The outer surface of the panels of the vest may comprise of but not limited to compartments, apertures, cavities, loops, inlet tube and MOLLE attachments (Modular Lightweight Load-carrying Equipment) and attachable components.

The disassembled open vest configuration illustrates the inner surface of the vest, in particular the panels and may comprises of but not limited to compartments, apertures, foam padding, securing elements, securing mechanisms such as fasteners and adjustable fasteners.

The multi-functional vest is designed for a user for physical activities, and may specify for athletes, hikers, campers, long distance runners, military personnel, front line workers and the general enthusiast. To add resistance, the user can add fixed or detachable resistance bands within the compartments on the inner surface and/or outer surface, weighted plates, filler weights. To stay hydrated during the physical activities, the user can utilize a hydration bladder, wherein the hydration bladder comprises of a tube and mouth piece, cavity and a cavity cap, inlet tube, filter. For physical activities in the dark, a reflector may have a visual detection. For outdoor activities, a source of renewal energy such as solar panels may be secured to the outer surface of the vest, wherein an opening around one or more panels can comprise of a port to charge electronics.

In a another disclosed aspect, the apparatus further comprises at least one removable hydration bladder in a compartment, wherein the compartment is expandable and may comprise of a waterproof coating, wherein the compartment comprises of a fastener such as a hook to be held in place, a tube of the hydration bladder is between one or more layers of inner surface of a shoulder strap, released from a cavity and secured on the outer surface of the shoulder strap.

In yet another disclosed aspect, the apparatus further comprises of an aperture on the outer surface of a panel of the multi-functional vest configured to access the inner surface of the panel, wherein the inner surface of the panel may have a distinct compartment to receive fluids, wherein the inner surface of the compartment comprises of flexible material for a transition from the inner surface of the compartment of the rear panel to the outer surface.

In yet another disclosed aspect, the vest apparatus further comprises of fluids being filled to the compartment, wherein the outer surface of a panel comprises of an inlet to insert a filter to filter out all chemicals, bacteria, mold for a user to hydrate by a tube either connected to the outer surface of the panel and/or inner surface to secure along the periphery inner surface and/or outer surface to the shoulder strap.

In a disclosed aspect, the apparatus outer surface comprises the selected: polyvinyl chloride (PVC), polyurethane coating (PU), plastic, nylon, neoprene, canvas, Cordura®, polyester, dtex, thermoplastic, polyurethane (TPU), transparent coatings, inherently buoyant, inflatable materials further comprising cartridges of carbon dioxide gas in combination thereof configured to prevent absorption of water and for a daily usage to increase the long-lasting durability or in some instances to float.

In another disclosed aspect, the apparatus further comprises one or more fasteners on the outer and inner surface, wherein the one or more fasteners comprises of the selected buckles, hooks, zip ties, adjustable working strap, cinch strap, hook and loop fastener and one or more layers of various securing mechanisms, securing elements in combination thereof for adjusting to the user's proportion, adjusting the dimensions of the compartments and opening or closing compartments.

In another disclosed aspect, the inner surface and outer surface coating of the apparatus comprises of mesh sponge padding, sponge to create buoyancy force configured as a personal flotation device comprising minimal to no articles around the multi-functional vest.

In another disclosed aspect, the apparatus further comprises hook and loop patches for cosmetic purposes.

In another disclosed aspect, the apparatus further comprises of steel wire configured to further provide adjustment on one or more fasteners to adjust to the user's body size, wherein the steel wire is tension band wiring.

In another disclosed aspect, the apparatus further comprises padded fastener flaps configured to comfortably attach and adjust over and under one or more shoulder straps on the front and/or rear panel.

In another disclosed aspect, the apparatus further comprises a connector on a fastener flap, wherein the connector may be configured as a loop for attachments.

In another disclosed aspect, the apparatus further comprises securing mechanism reinforcement or MOLLE attachment to secure at least one fixed loop comprising of one or more anchor with minimal space in between the vest structure and fixed attachment creating minimal to no movement of one or more attachments with at least one coating of polyvinyl chloride (PVC), polyurethane coating (PU).

In another disclosed aspect, the vest may comprise of at least one fastener flap on the outer surface of the vest; at least one fastener flap on a rear compartment of the vest; at least one fastener flap on a side panel of the vest; at least one reinforcement on one or more of the fastener flaps; at least one hidden reinforcement; at least one side panel of the vest having one or more hooks in combination thereof.

In another disclosed aspect, the apparatus further comprises a pair of rear shoulder straps comprising of one or more buckles, fastener flap, a loop, one or more layers of foam and mesh.

In another disclosed aspect, the apparatus further comprises a stitched securing mechanism reinforcement with an opening with a visual detection as a MOLLE attachment comprising at least one coating of polyvinyl chloride (PVC) and/or polyurethane coating (PU).

In another disclosed aspect, the apparatus further comprises one or more reinforcement such as metal materials or of one or more layers of binding, one or more nylon stitching, one or more threads, or one or more rivets, one or more nuts, one or more bolts, one or more buttons, one or more clips, one or more screws, one or more pins and one or more layers of thread stitching with a mixture of minerals such securing mechanism with a fabric mixture, Nylon, or polyester with one or more layers to the surface of the vest in an assembled and disassembled vest configuration.

In another disclosed aspect, the apparatus further comprises of high tenacity nylon and internal lashing loops to secure tether attachments and articles.

In another disclosed aspect, the apparatus further comprises at least one opening divider within one or more of the compartments, wherein the divider is configured to secure the resistance bands in a portion of the compartment.

In another disclosed aspect, the apparatus further comprises of minimal to no weight, wherein additional weight to be used as a flotation tool on a surface of water wherein weighted articles secured in one or more inner and outer compartments secured by at least one reinforcement creating additional weight to the vest alongside the user's body weight, while in water, causing the user to sink wherein underwater training can be implemented.

In another disclosed aspect, the one or more resistance bands comprises of one or more adjustable working straps and at least one layer of fabric strap configured to increase or decrease the length or tension thereof.

In another disclosed aspect, the one or more resistance bands fixed with at least one reinforcement are configured to descend from the one or more compartment as attachments, with at least one hook to attach onto one or more limb straps and attachable articles.

In another disclosed aspect, the one or more resistance bands are configured to descend from the one or more openings as attachments to increase resistance.

In another disclosed aspect, a detachable resistance bands comprises of a hook and adjustable working strap or fastener.

In another disclosed aspect, a harness is configured as a less constructed apparatus.

In yet another disclosed aspect, the apparatus further comprises one or more fixed or removable solar panel on the inner or outer surface of a panel of the apparatus.

In another disclosed aspect, the apparatus comprises of pockets configured to insert a solar panel and for devices.

In another disclosed aspect, the apparatus further comprises one or more fixed or removable reflectors on the inner or outer surface of a panel.

In another disclosed aspect, the apparatus comprises of a fixed or removable electronics.

BRIEF DESCRIPTIONS OF THE FIGURES

The principles of the invention may better be understood with reference to the accompanying figures provided by way of illustration of an exemplary embodiment, or embodiments, incorporating principles and aspects of the present invention, and in which:

FIG. 2 is a rear perspective view of the multi-functional vest in particular.

FIG. 3 are four perspective view of a rear compartment of multi-functional vest, in particular

FIG. 4 is a top side perspective view of the multi-functional vest and compartment weights, in particular FIG. 4A is a top side perspective view of the multi-functional vest in a closed assembled vest configuration;

Figure 6A:
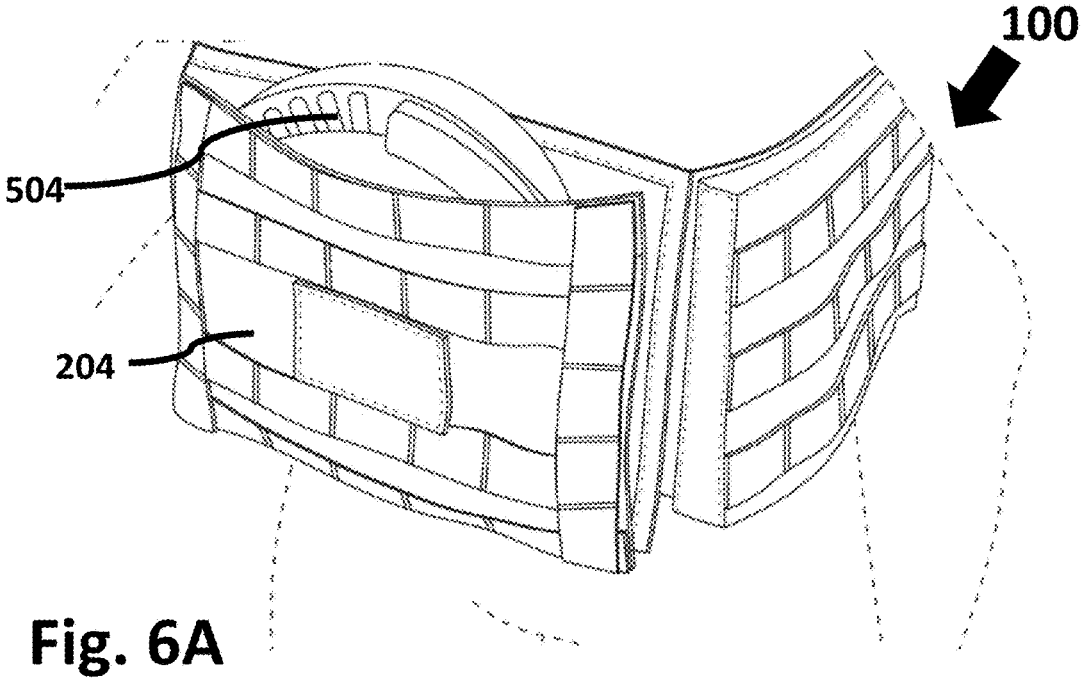
Figure 6B:
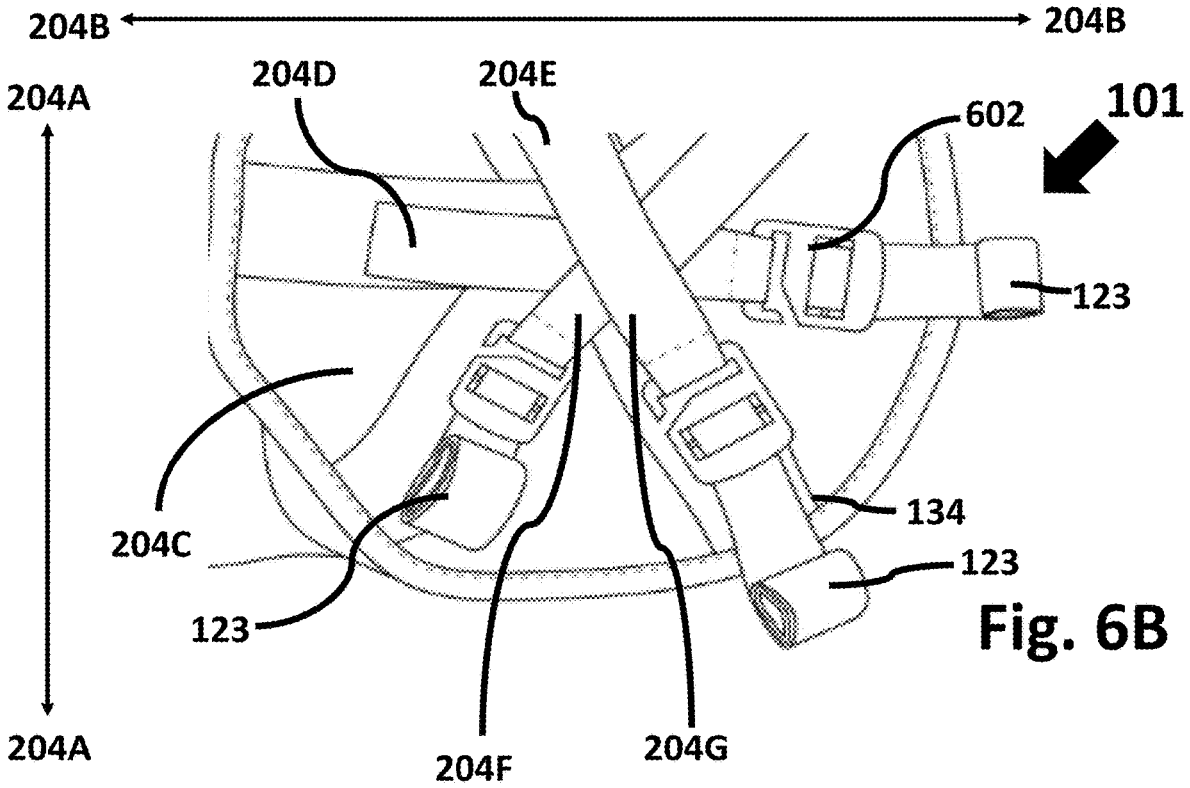
Figure 8:
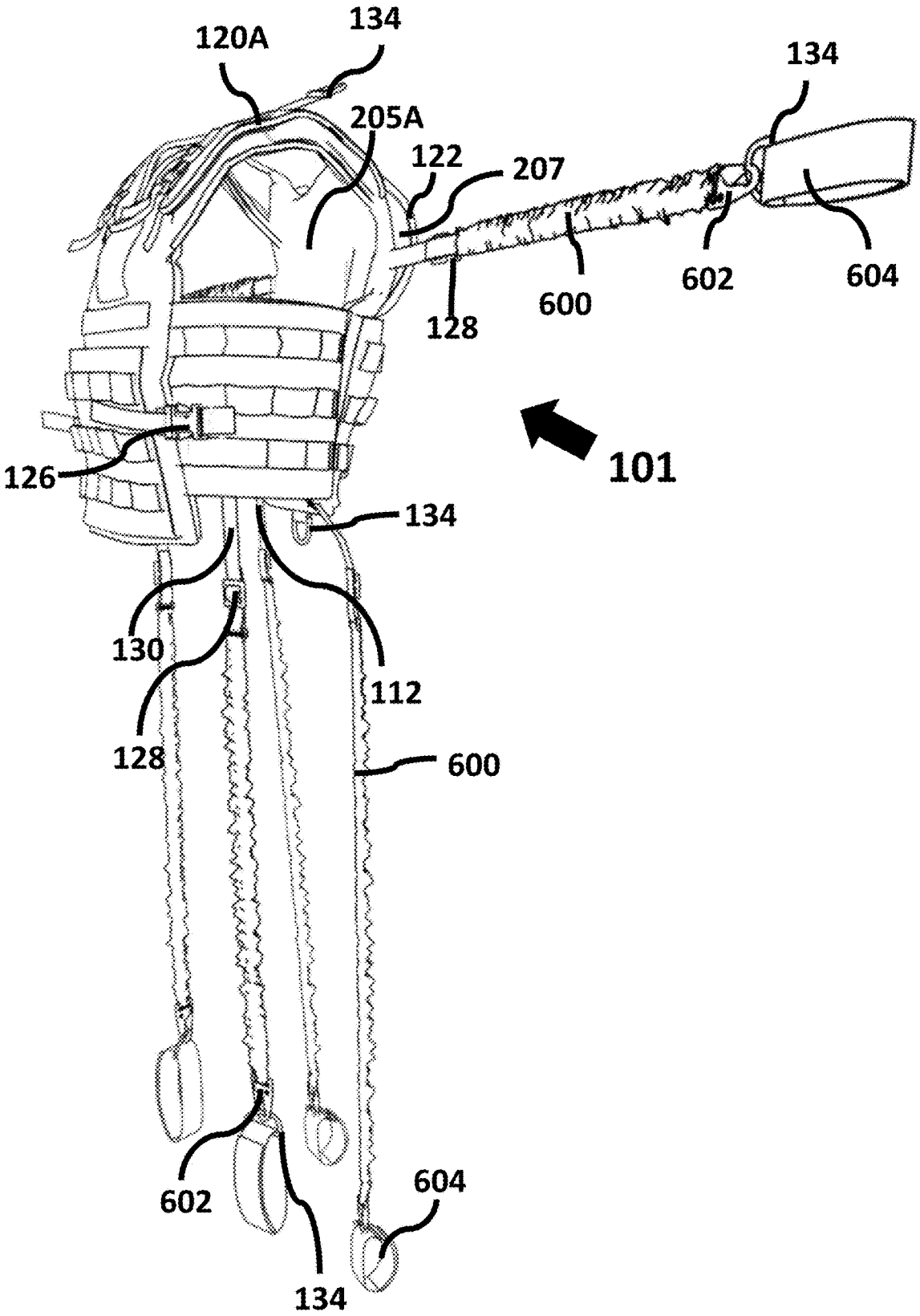
Figure 9:
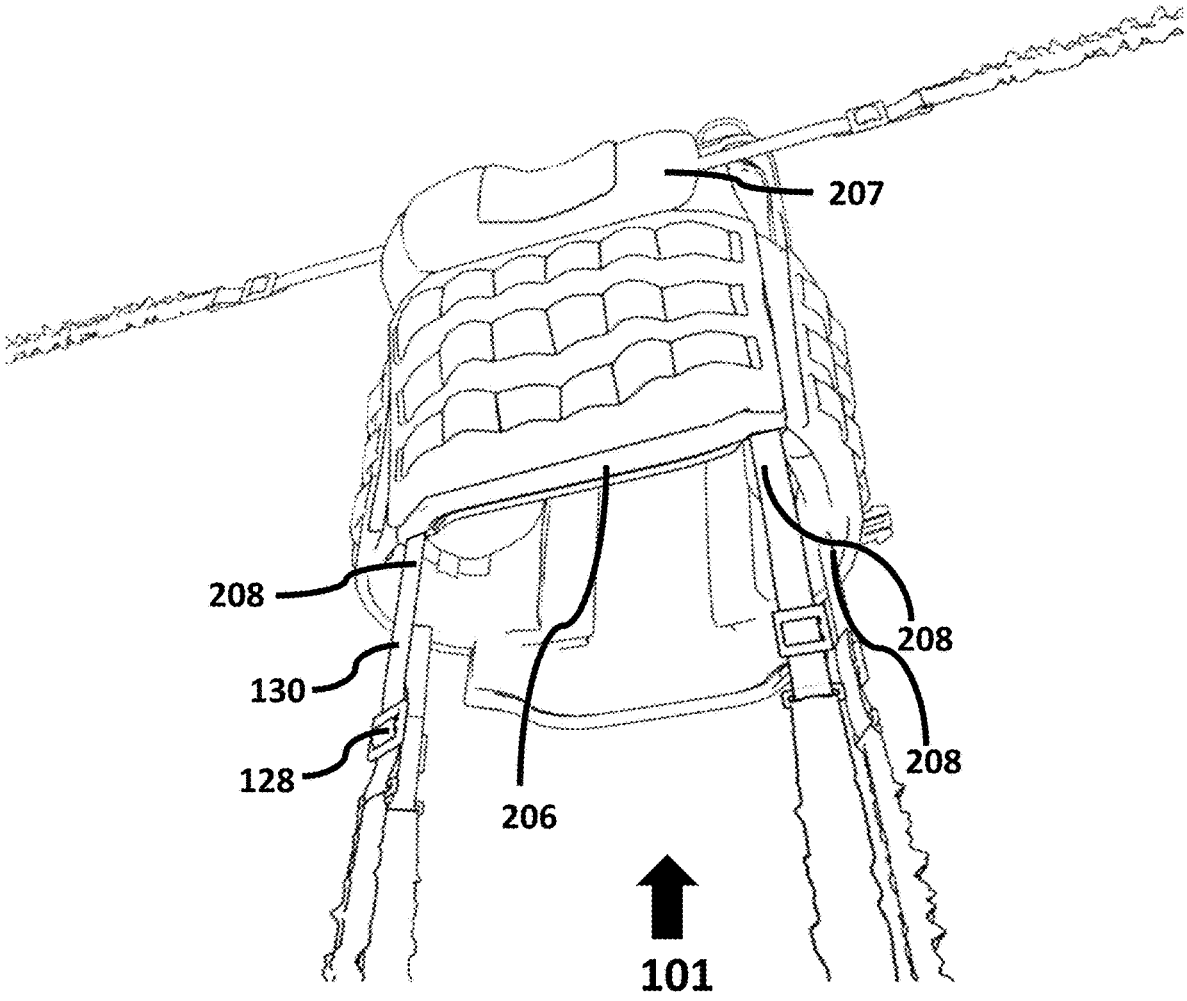
Figure 10:
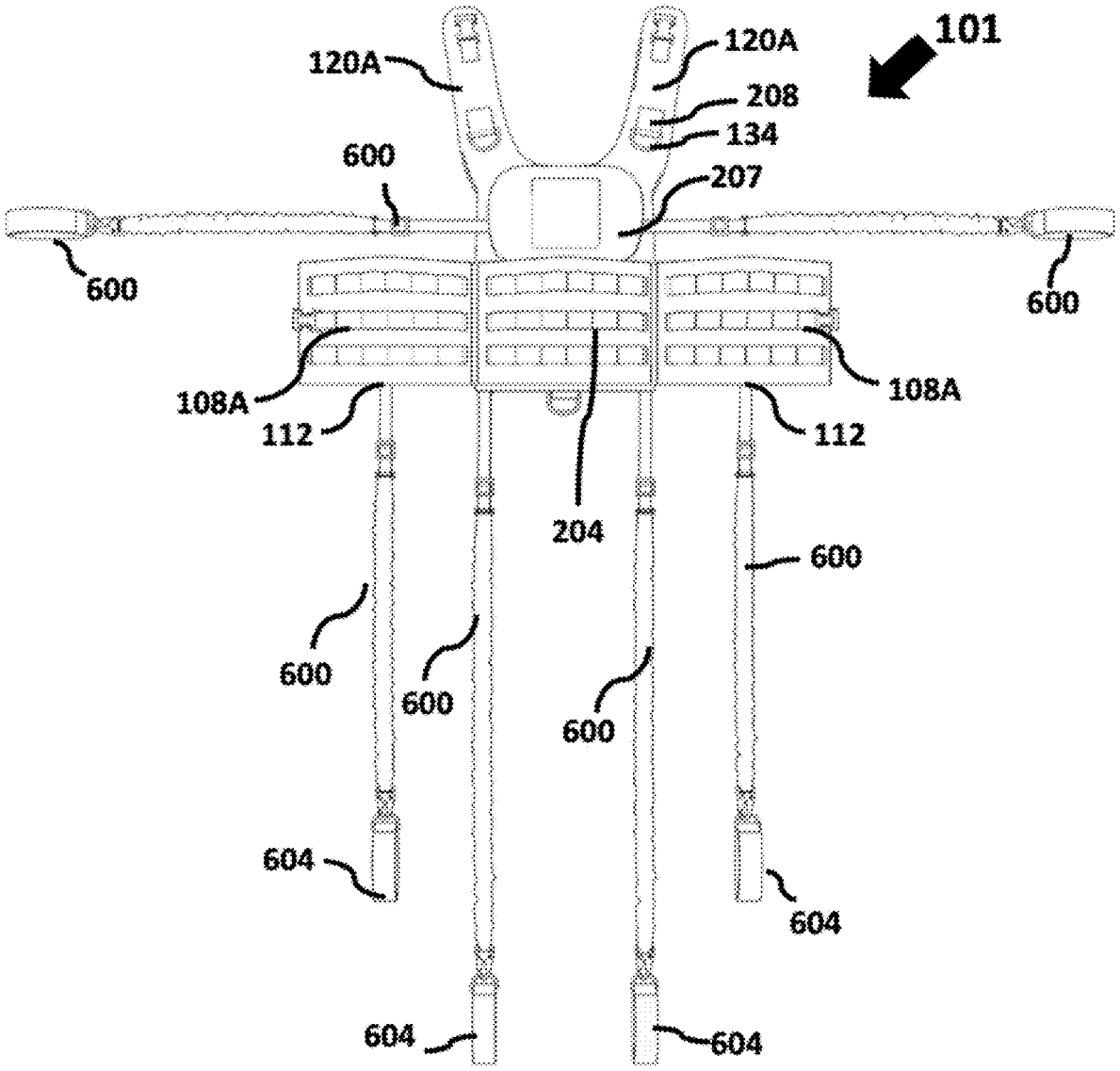
Figure 12A:
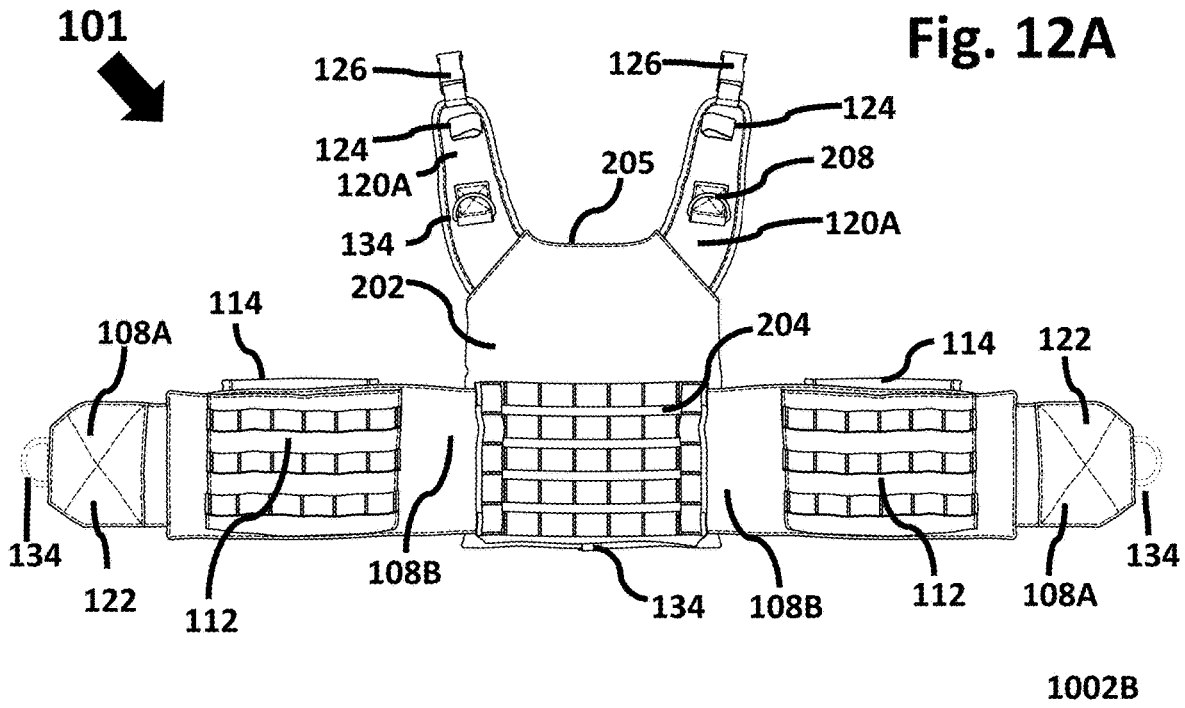
Figure 12B:
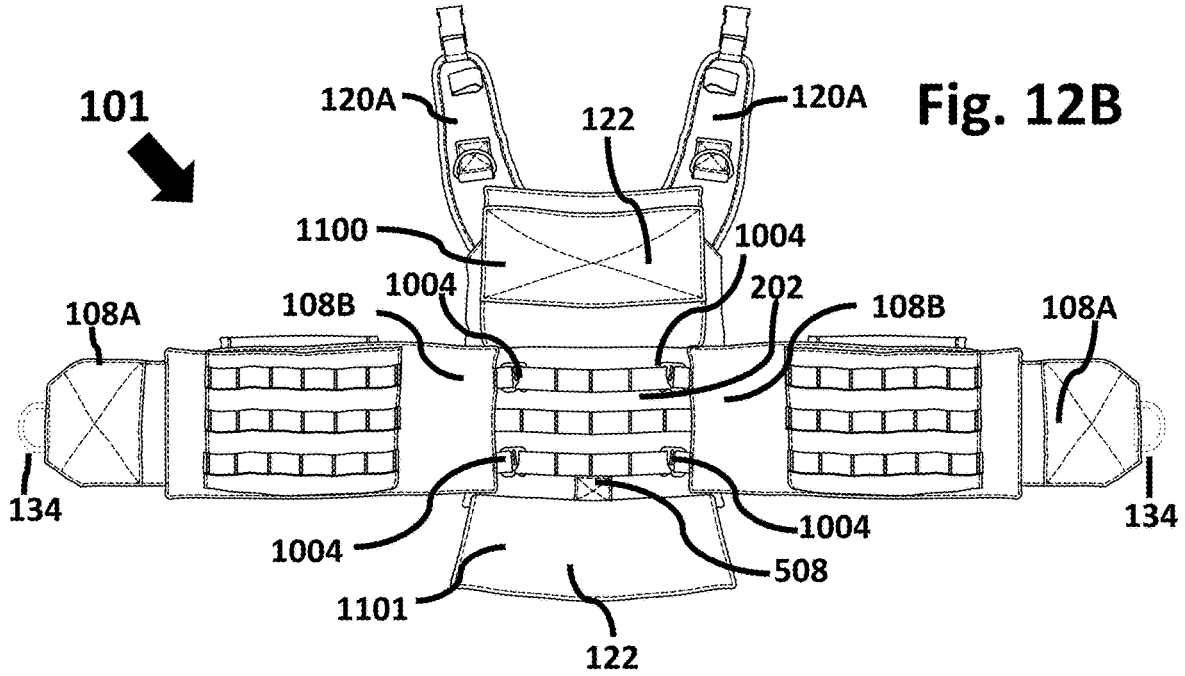
Figure 13:
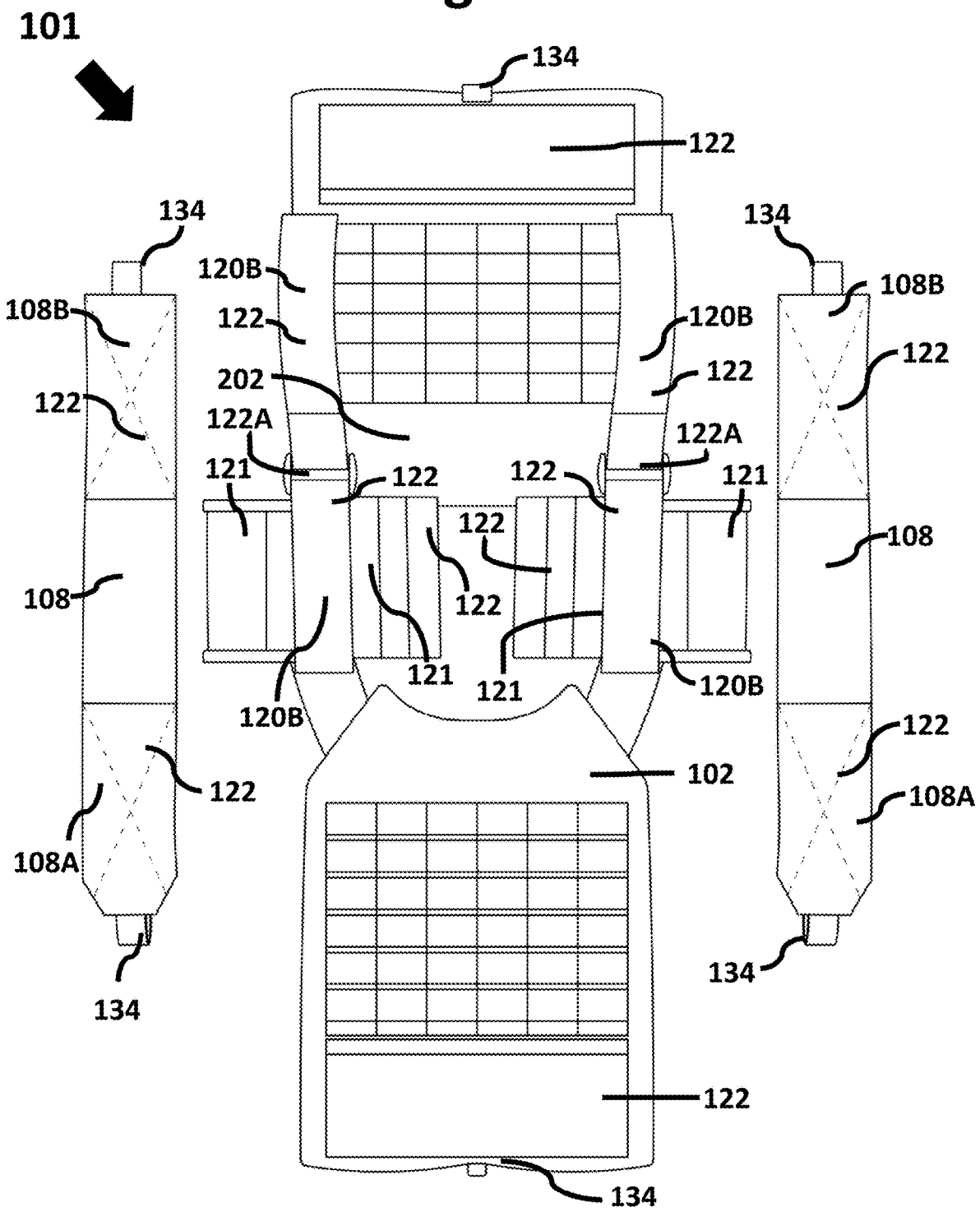
Figure 14A:
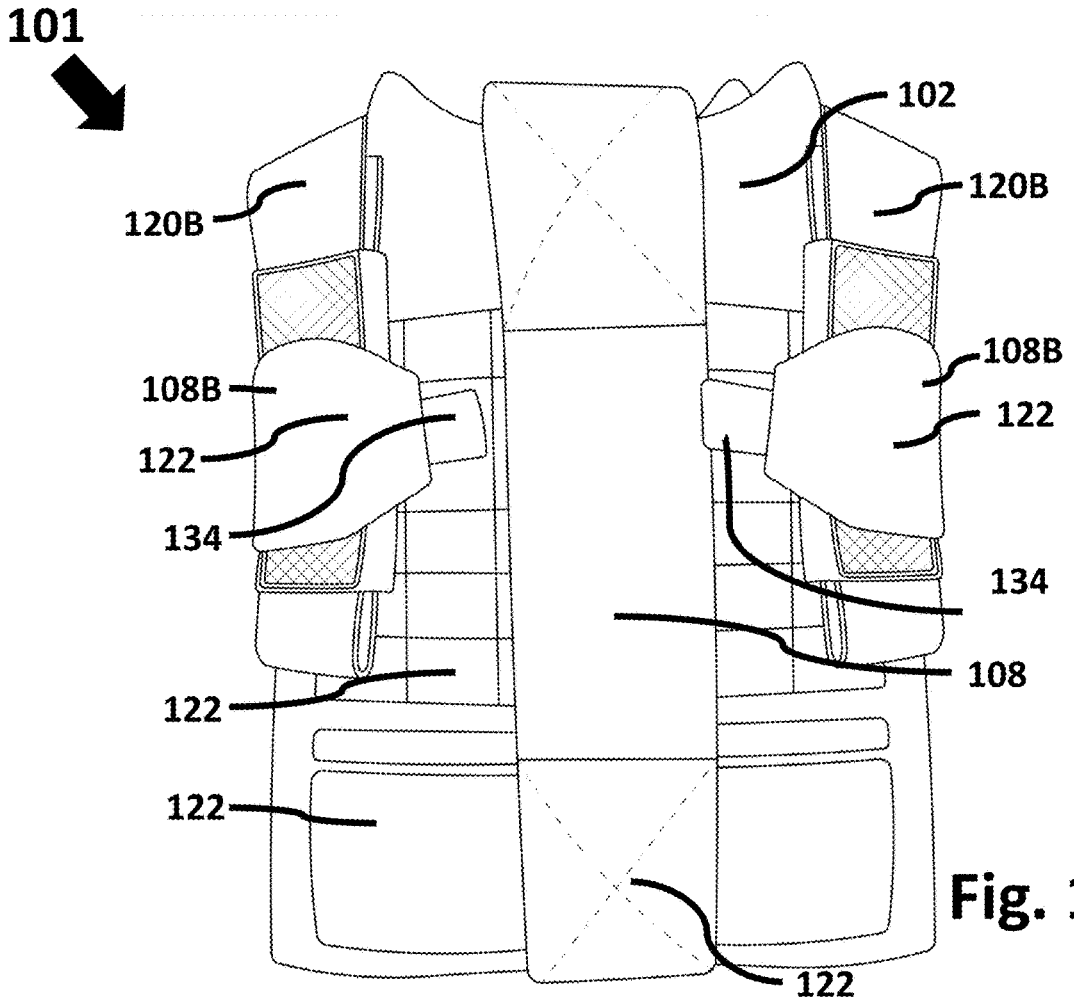
Figure 14B:
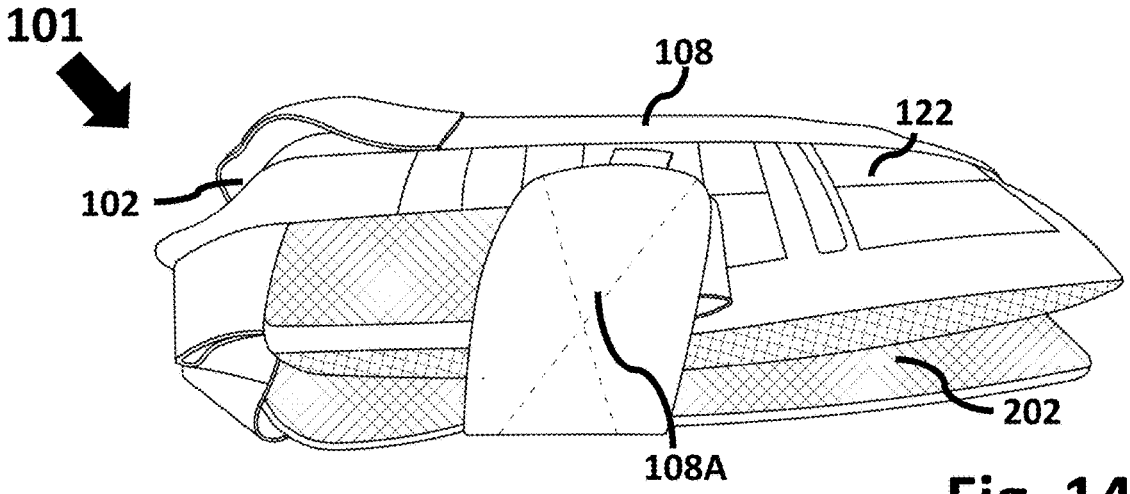
Figure 15A:
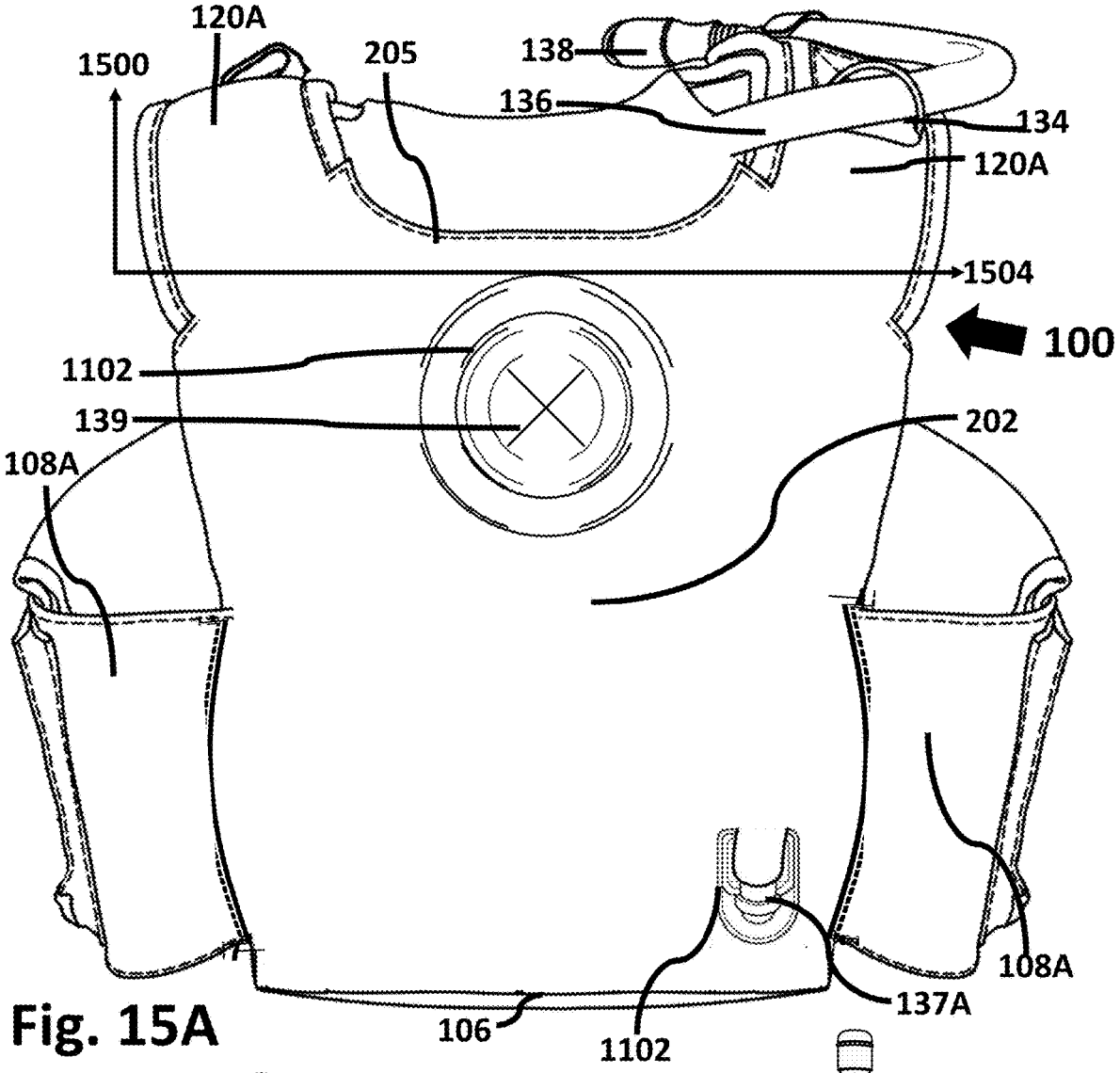
Figure 15B:
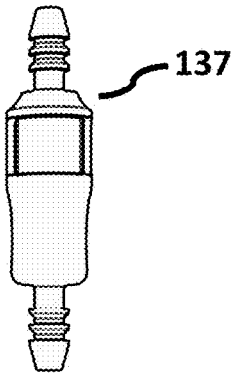
Figure 15C:
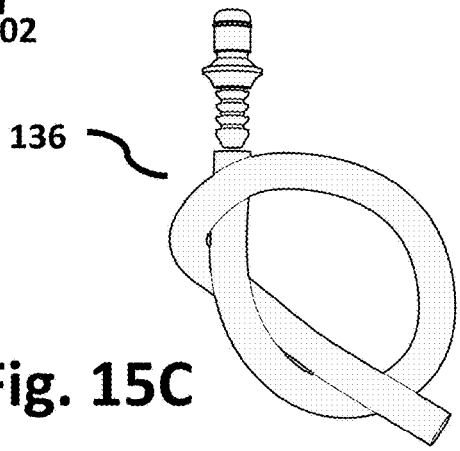

FIG. 4B-C is a front perspective view of a set of weights;

FIG. 5 is a bottom perspective view of the multi-functional vest and a set of weights, in particular FIG. 5A is a bottom side perspective view of the multi-functional vest in the assembled closed vest configuration;

FIG. 5B is a bottom perspective view of a panel compartment when opened;

FIG. 5C-D is a front perspective view of a set of weights;

FIG. 6 is a front perspective view of a compartment of the multi-functional vest, in particular FIG. 6A is a user placing a weight to the enclosure of the front compartment;

FIG. 6B is the inner surface of the front compartment including a set of adjustable straps;

FIG. 7 is a front perspective view of the multi-functional vest and resistance components, in particular FIG. 7A is a front perspective view of the multi-functional vest with resistance bands deployed from a set of compartments attached to limb straps in the assembled closed vest configuration;

FIG. 7B is a front perspective view of a limb strap;

FIG. 7C is a front perspective view of a detachable resistance band;

FIG. 8 is a side perspective view of the multi-functional vest with resistance bands deployed from a set of compartments and attached to limb straps in the assembled closed vest configuration;

FIG. 9 is a bottom-side perspective view of the multi-functional vest comprising of resistance bands deployed from a set of compartments in the assembled closed vest configuration;

FIG. 10 is a front perspective view of the rear multi-functional vest comprising of resistance bands deployed from a set of compartments attached to limb straps in the disassembled open vest configuration;

FIG. 11 is a front perspective view of the multi-functional vest transition to an open configuration, in particular FIG. 11A is a front perspective view of the multi-functional vest in the assembled closed vest configuration;

FIG. 11B is a front perspective view of the multi-functional vest front panel flap disengaged from the side panel flaps in the assembled closed vest configuration;

FIG. 11C is a front perspective view of the multi-functional vest front panel flap disengaged from the right-side panel flap revealing an inner compartment opened;

FIG. 12 is a rear perspective view of the multi-functional vest transition to an opened vest configuration, in particular FIG. 12A is a rear perspective view of the multi-functional vest and two side panels in the opened vest configuration;

FIG. 12B is a rear perspective view of the multi-functional vest rear panel flaps disengaged from each other, revealing the inner surface of the rear panel;

FIG. 13 is a top perspective view of the front panel and the rear panel engaged by a set of shoulder straps, wherein the set of shoulder straps comprises of shoulder strap flaps and two side panels disassembled, each side panel flat upon a surface;

FIG. 14 is a view of the multi-functional vest disassembled, in particular;

FIG. 14A is a top perspective view of the multi-functional vest disassembled, all components secured by a set of side panels;

FIG. 14B is side-bottom perspective view of the multi-functional vest disassembled with a panel generally flat upon a surface secured by a set of side panels;

FIG. 15 is a rear perspective view of the multi-functional vest and components, in particular FIG. 15A is a rear perspective view of the multi-functional vest with a hydration cap and an inlet port on the outer surface of the rear panel and a hydration tube released from the rear compartment;

FIG. 15B is a front perspective view of an filter;

FIG. 15C is a front perspective view of a hydration tube;

FIG. 16 is a front perspective view of a vest harness, in particular

Figure 16A:
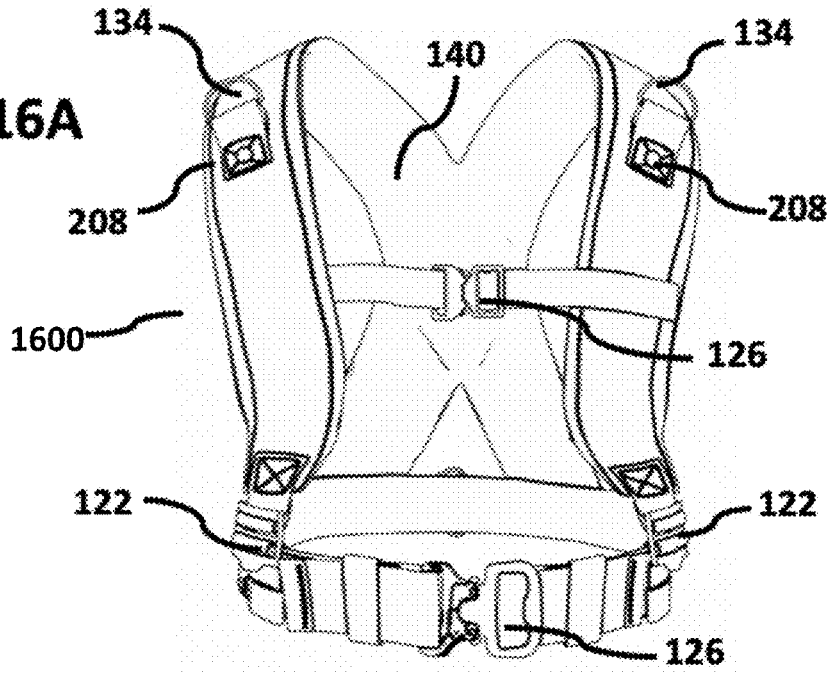
Figure 16B:
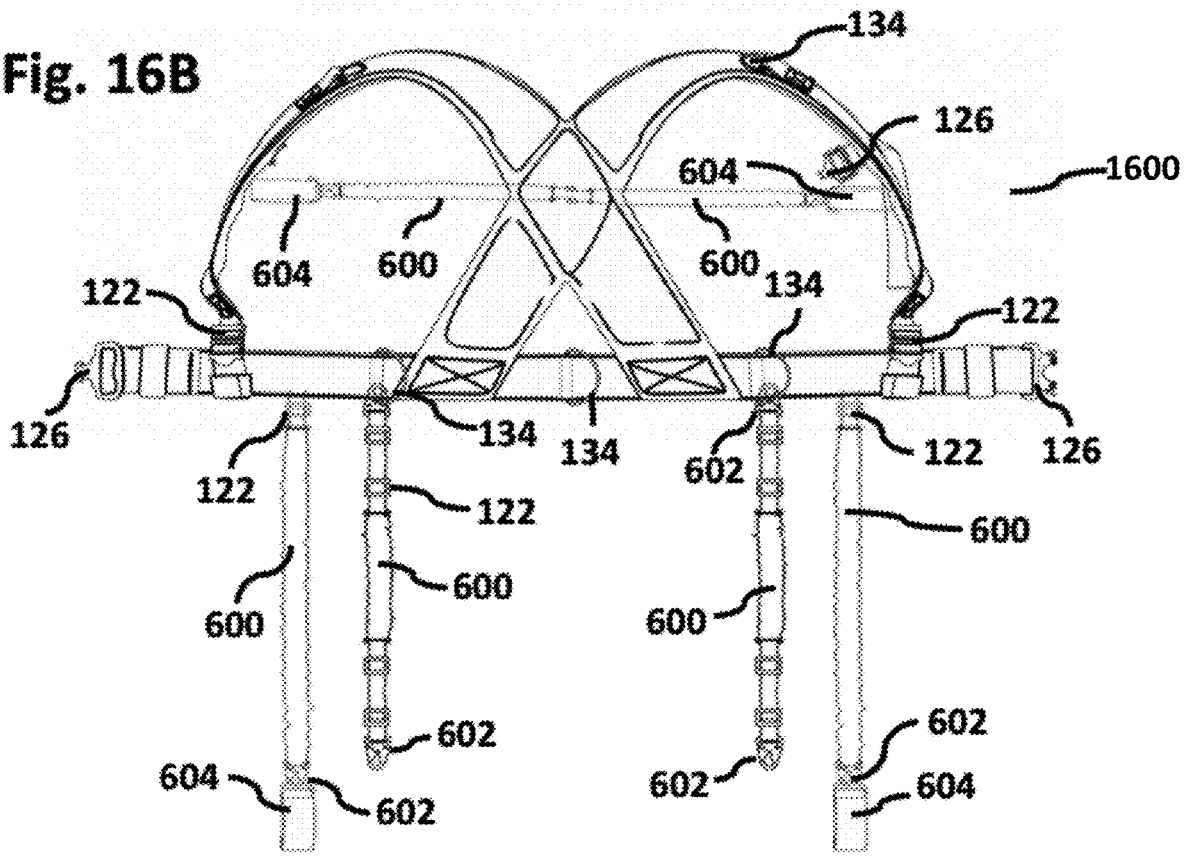

FIG. 16A is a front perspective view of vest harness in the assembled configuration; and FIG. 16B is the rear perspective view of the vest harness with two resistance hands deployed from a compartment or an outer surface with a set of limb straps, four resistance deployed from a waist strap, two resistance bands attached to a set of limb strap and two resistance bands.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like part are marked throughout the specification and the drawings with the same respective reference numerals. The drawings are not necessarily to scale, and in some instances, proportions may have been exaggerated in order more clearly to depict certain features of the invention. Subject matter is described throughout this specification in detail and with specificity in order to meet statutory requirements. The aspects described throughout the specifications are intended to be illustrative rather than restrictive, and the description itself is not the intended necessarily to limit the scope of the claims. Rather, the claimed subject matter might be practiced in other ways to include different elements or combinations of elements that are equivalent to the ones described in this specification and that are in conjunction with other present technologies or future technologies. Upon reading the present disclosure, alternative aspects may become apparent to ordinary skilled artisans that practice in areas relevant to the description aspects, without departing from the scope of this disclosure.

The present invention can be realized in various embodiments, each incorporating alternative features that achieve similar objectives. It will be understood that certain features and sub-combinations are of utility and may be employed without reference to other features and sub-combinations. This is contemplated by, and is within the scope of, the claims.

The vest comprising a front panel 102, a rear panel 202 and a set of side panels 108 and a set of shoulder straps 120A-B engaged with each other to reference, illustrate, understood and defined as element 100. It is understood and appreciated the term closed vest configuration, assembled vest, main body is references and remains as element 100. The side panel(s) is referred as element 108 however, the side panel(s) can be interpreted, understood and illustrated as waist strap(s).

When the panels are disengaged from each other, the compartments opened, shoulder straps not engaged with each other, to reference, illustrations, in other words the vest illustrating an inner surface and/or opening to define as element 101. It is understood and appreciated the term open vest configuration, disassembled vest remains as element 101.

It is understood the closed bag configured 100 is the outer surface(s) of the multi-functional vest 100 wherein the open vest configuration 101 illustrates the inner surface(s).

In some instances, the multi-functional vest may not be referenced however, the vest is understood and interpreted as the multi-functional vest throughout the specifications and will further explain and reference the figures. Also, the term outer surface is to be understood on the outwards direction of the multi-functional vest and the term inner surface is the opposite side of the outer surface. The term less constructed is to be understood features can be removed or added prior, during or post manufacturing, depending on the users request.

The multi-functional vest 100 comprises of one or more panels 102, 108, 202 further wherein one or more panels may comprise of one or more compartments on the outer and/or inner surface configured for opening to receive and secure one or more articles.

It is to be understood the term compartments and chamber may be the similar enclosure to hold and secure one or more articles.

Figure 1:
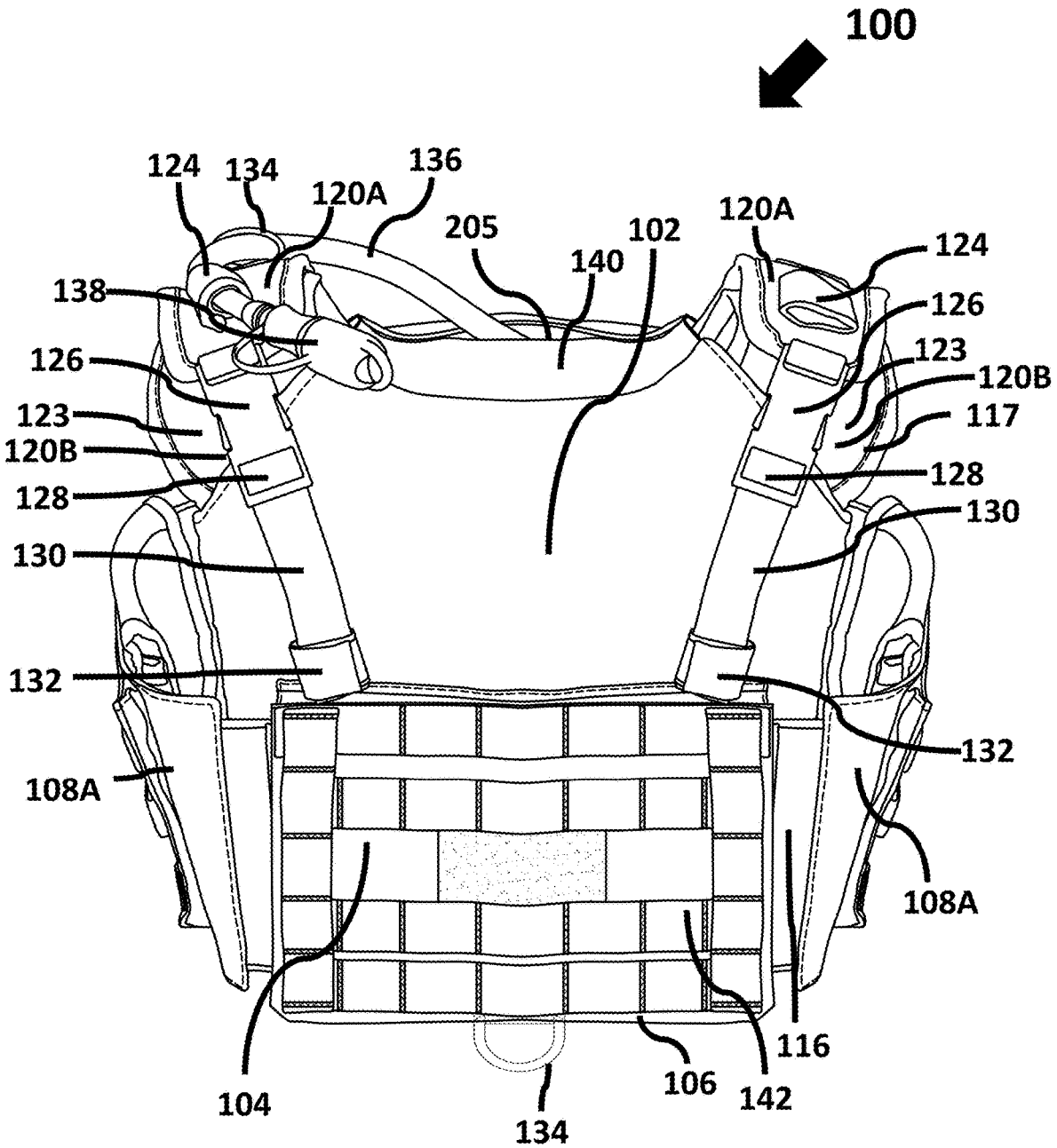
FIG. 1 is a front perspective view of a multi-functional vest comprising of a removable hydration bladder in the assembled closed vest configuration.

FIG. 1 illustrates a front panel 102 comprising of a set of compartments 104, 110 configured to hold one or more articles, wherein the one or more articles can comprise of personal belongings, weighted plates, filler weights, one or more hydration bladders, not limiting to other articles. Additionally, the outer surface and inner surface of one or more panels 102, 108 may comprise of a MOLLE attachment 142 (Modular lightweight load-carrying) for connecting and securing attachments and accessories and cosmetic purposes such as hook and loop patches, wherein attachments 142 may include but not limiting to a gun holster secured on one or more MOLLE attachments 142. In some instances, a MOLLE attachment 142 can be secured by a securing mechanism to the outer surface of one or more panels of the multi-functional vest in a direction of vertical, horizontal, perpendicular or similar directions. It is understood a MOLLE attachment 142 is viewed in the figures and may appear as a square however, the MOLLE attachment 142 can be more or less constructed, wherein less constructed can be a decreased layer, dimensions and position. The MOLLE attachment 142 is positioned on the outer surface of the front panel compartment 104 and/or side panel in a vertical direction wherein the periphery outer surface of the front compartment 104 comprises of a set of MOLLE attachments 142 secured in a horizontal direction. With respect to the shoulder straps 120A-B, the MOLLE attachments 142 can be secured on outer surface and/or periphery surface of one or more shoulder straps 120A-B. In some embodiments, a MOLLE attachment 142 may be used as a stabilizer 124 on the outer surface to the shoulder strap 120A-B configured to receive and secure accessories such as but not limited to a hydration tube 136.

A user can correct poor posture by uplifting the upper torso by increasing the tension of the buckle 126 in particular the lower part of the buckle is a adjustable working strap 128 of a rear shoulder strap 120A and other fasteners on the multi-functional vest. In addition, the fastener 122 is configured to attach and secure to the outer surface of the multi-functional vest 100. It is understood the buckle 126 comprises of a bottom component which is a ladder, for adjusting the length, in other terms and adjustable working strap. In some embodiments, the loose end of the fabric 130 may be secured and positioned on the outer surface of the front panel, wherein the adjustable working strap is the sole fastener 122 of the shoulder strap 120A.

In addition, FIG. 1 illustrates a total of four shoulder straps 120A-B, wherein the front panel 102 comprises of two front shoulder straps 120B and the rear panel 202 comprises of two rear shoulder straps 120A. It is understood one shoulder strap 120B of a front panel 102 comprises of one side of a hook and loop fastener, wherein the rear shoulder strap 120A comprises of the opposite side of the hook and loop fastener 123 of the rear shoulder strap 120 configured to attach and engage with each other. Overtime the strength and durability of the shoulder straps 120A-B may decrease wherein the rear shoulder straps 120A wherein an additional fastener 122 may be manufactured on a rear shoulder strap 120A wherein the additional fastener is a buckle 126 configured as an additional securing mechanism. For example, the two rear shoulder straps 120A are engaged with the two front shoulder straps 120B via a hook and loop fastener 123 wherein the additional fastener is a buckle 126 wherein the buckle comprises of an adjustable working strap 128 known as a ladder within the ladder is underneath the female side of a buckle 126 wherein a spacer of the adjustable working strap 128 comprises of a fabric strap 130 is configured to receive through the spacer. In addition, a fabric flap 132 comprises of a hook and loop fastener configured to fold over itself to decrease the length. For example, a starting point of a rear shoulder strap 120A comprises of a layer of fabric secured to the rear shoulder strap 120A of the front panel 102. The fabric is then looped around at least once through the bottom through the adjustable working strap ladder 128 wherein the adjustable working strap 128 comprises of the spacer for a separation of the single fabric, wherein a first fabric is going in one direction wherein a second layer of fabric is going in the opposite direction to receive and secured the fabric strap 130.

In some embodiments, a loop 134 is secured to the outer surface of the front panel 102 rear panel 204 shoulder strap 120A-B and/or the outer periphery surface of the side panel, for attaching accessories or articles, minimizing movement. The ending of the fabric comprises of a hook and loop fold 132 to fold over itself to either increase or decrease the length in fabric. An example, a user with a smaller torso size may have excessive loose fabric as depicted in FIG. 1. To decrease the length of the fabric, the user may fold over the fabric at least once, wherein the ending point comprises of a hook and loop fastener 132 to fold over itself securing the fabric. The opposite receiving side of the buckle 126 is stitched or fixed onto the second rear shoulder strap 120A of the rear panel 202 to receive and engage with each other.

A rear shoulder strap 120A can comprise of a stabilizer 124 on the outer surface of the one or more shoulder straps configured to secure articles with minimal to no movement during movement. For example, FIG. 1 illustrates a hydration tube 136, in particular the hydration tube 136 deployed from the rear compartment 205. The tube 136 can either pass through the loop 134 on the outer surface of the rear shoulder strap 120A configured to be secured to the stabilizer 124 the stabilizer comprises of a mouth piece 138 for drinking purposes. The stabilizer 124 can be manufacture as the same layer of the rear shoulder strap 120A or as an additional fabric, wherein the fabric may comprise of a layer of securing mechanism 208 and a fastener 122 such as a hook and loop fastener 134. It is understood a stabilizer 124 can secure headphones or other articles. In some instances, the stabilizer can be fixed onto the rear shoulder strap flap. The rear shoulder straps 120A can comprise of one or more compressed lining, known as foam padding, further comprising the selected of polyurethane foam, cushion, memory foam, latex foam, breathable air mesh, air cooling gel pads, light weight polyester mesh, in combination thereof, which element name is padding 140. During manufacturing, a layer of padding 140 can comprise of a first layer of the rear shoulder strap 120A to wrap around the rear shoulder strap 120A outer fabric, wherein is secured to one or more layers via securing mechanism 208. It is understood a panel may comprise of a set of compartments 106 positioned either on the top, bottom or periphery surface.

FIG. 2 illustrates the rear perspective view of the vest in the assembled closed vest configuration 100 comprising of a hydration bladder secured in the rear compartment 205. The hydration tube 136 is designed to provide easy access for fluids stowed in a hydration bladder allowing users to hydrate without removing the entire hydration bladder 135 out of the rear compartment 205. The rear compartment 205 housing the hydration bladder is typically designed with an opening or port that allows the hydration tube to extend outside while maintaining a secure fit when not in use. This can be achieved through a flexible or semi-rigid design that allows the tube to be pulled out conveniently. In some instances, the hydration tube 136 is directly disposed from the rear compartment 205 wherein the hydration bladder is partially revealed, depending on the perspective view looked upon.

The hydration tube 136 may be through the loop 134 to prevent minimal to no movement of the tube 136 during physical activities. The outer base of the loop 134 comprises of a layer of securing mechanism 208 such as at least one layer of fabric secured to the outer surface of the rear shoulder strap 120A however, depending manufacturing method, the loop 134 may be constructed on the periphery outer surface of the front and/or rear shoulder straps 120A-B. To increase the durability, thread stitching selected from webbing, nylon, polyester, canvas and securing mechanism in combination thereof. The ending of the securing mechanism 208 comprises of a layer fabric configured as a smaller loop 134 configured to secure the larger loop 134, wherein the larger loop 134 may have shaped dimensions as a D-ring. The D-ring can be welded and fixed to prevent any disconnection and separation during movement. In some embodiments, the securing mechanism 208 can be configured as a fabric loop, wherein the loop comprises of a layer of the base of the securing mechanism 208. It is understood the term securing mechanism 208 on the rear shoulder strap is configured to secure a component, wherein the securing element 208 may comprise of the layer of fabric. In some instances, the loop can comprise of a layer of fabric on the outer surface of the rear shoulder strap 120A, wherein is looped and secured between the periphery outer surface. Additionally, the loop 134 may be configured as a grip, depending on the size made. Depending on the intended purpose for the multi-functional vest, the loops 134 and securing mechanism 208 can comprise of a rivet on the outer surface of the top layer of the securing mechanism 208 then to the inner surface of the rear shoulder strap 120A. The periphery outer surface of the rear shoulder strap 120A may comprise of a layer of binding, wherein the binding can be manufactured comprising of one or more layers of fabric. In some embodiments, the loop 134 is for attachments such as straps for pulling motion or for grasping such as hauling activities. rear panel 202 wherein portion of the grip is elongated between the inner surface to the outer surface or vice versa.

Figure 2A:
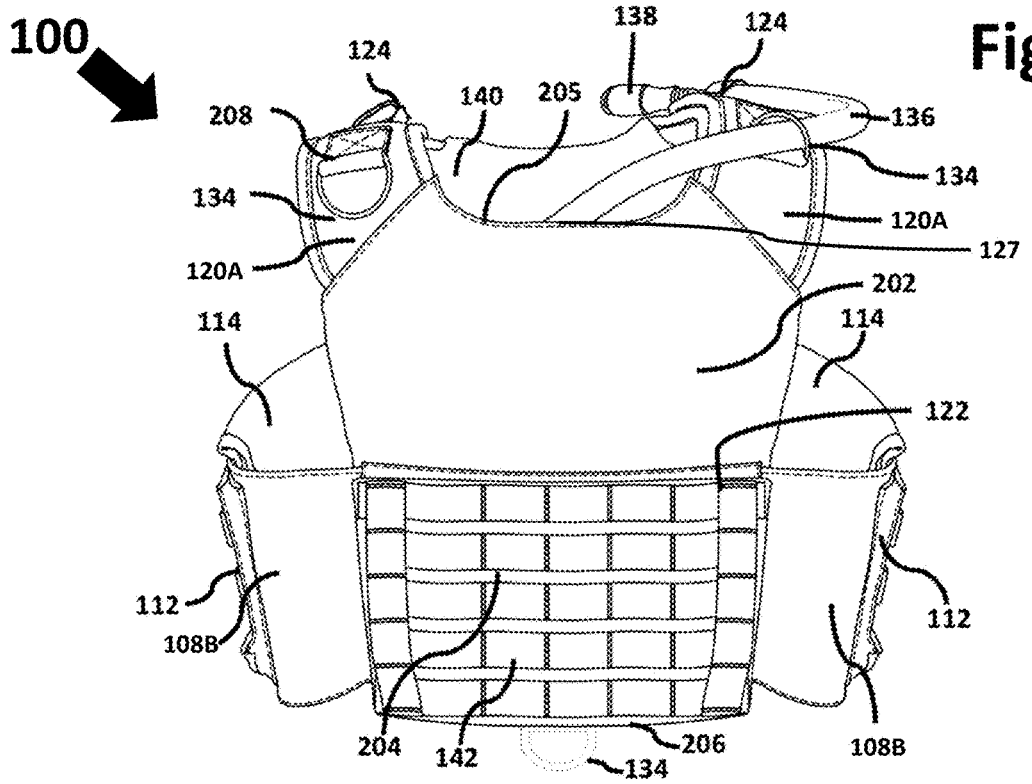
FIG. 2A is a rear perspective view of the multi-functional vest comprising of a removable hydration bladder in the assembled closed vest configuration.

In some embodiments, the side panel 108A-B comprises of a set of endings, wherein FIG. 2A illustrates an ending 108B secured to the outer surface of the rear panel 202 wherein the rear compartment 204 is extended overtop to increase the durability. For storage purposes, a set of compartments 112, 206 and 114 are configured for weights for resistance training. Each compartment comprises of a fastener 122 configured to open and close the compartment 112, 206 and 114 wherein each compartment is expandable with respect to the flexible durable layers of fabric on the inner surface and/or outer surface.

Figure 2B:
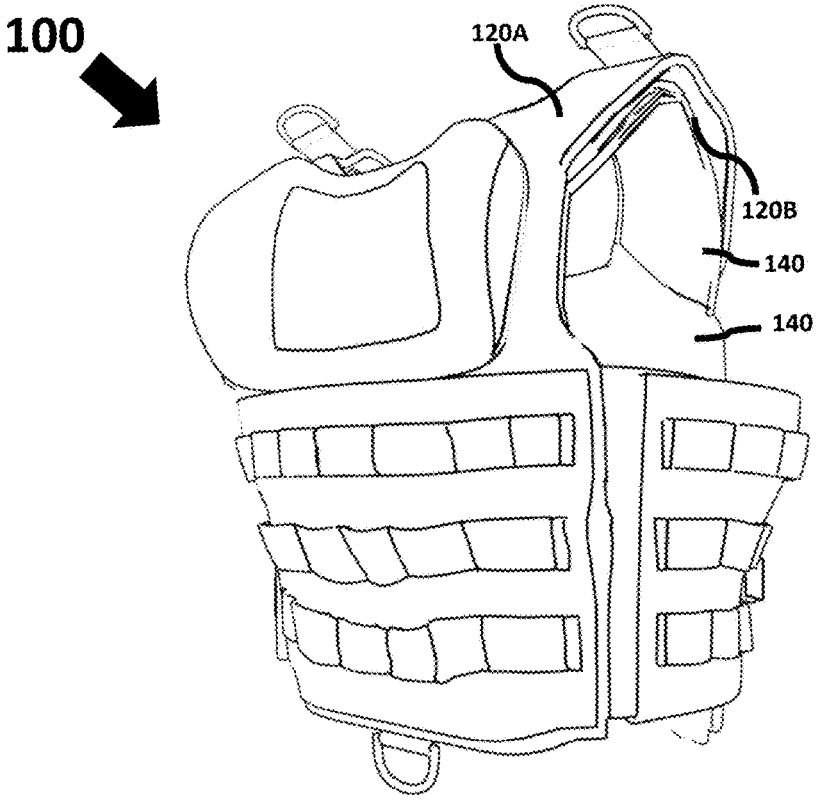
FIG. 2B is a rear side perspective view of the multi-functional vest in the assembled closed vest configuration.

FIG. 2B illustrates an inner surface fabric of the front panel 102 wherein a line spacing is between the inner surfaces of the rear panel 202, wherein the line spacing is configured to align with a user spine for comfort during movement. In some instances, the remaining inner surface of the rear panel 202 can comprise of spacing to fit the users back such as but not limited too shoulders, rhomboids, not limiting to similar muscle groups. In some embodiments, an air-cooling gel pockets are configured on the inner and outer surface of the rear shoulder strap 120A to the inner fabric surface, over or under a layer of foam previously described. In some instances, the air-cooling gel pockets can comprise of the selected, mesh, foam, compressed lining, compressors in combination thereof to maintain ventilation. It is understood the air-cooling gel pockets may be configured as an additional padding with respect to the soft gel packets. Also, the air-cooling gel pockets can comprise of a slight visual detection depending on the perspective view looked upon and raised from the inner surface of a panel and rear shoulder straps 120A. The line spacing located on the inner surface of a rear panel 202 can comprise of air-cooling gel pockets on or around the lining of the spine for additional support. Additionally, the inner surface of the rear shoulder strap 120A can comprise of inserts for removable gel packs configured to decrease the amount of heat of the body. For example, during movement, a user can insert gel packs around the rear shoulder strap(s) 120A-B wherein the insert comprises of a fastener. It is understood the air-cooling gel inserts can be manufactured separately, thus retailing the multi-functional vest with an air-cooling gel inserts are an alternative.

Figure 3A:
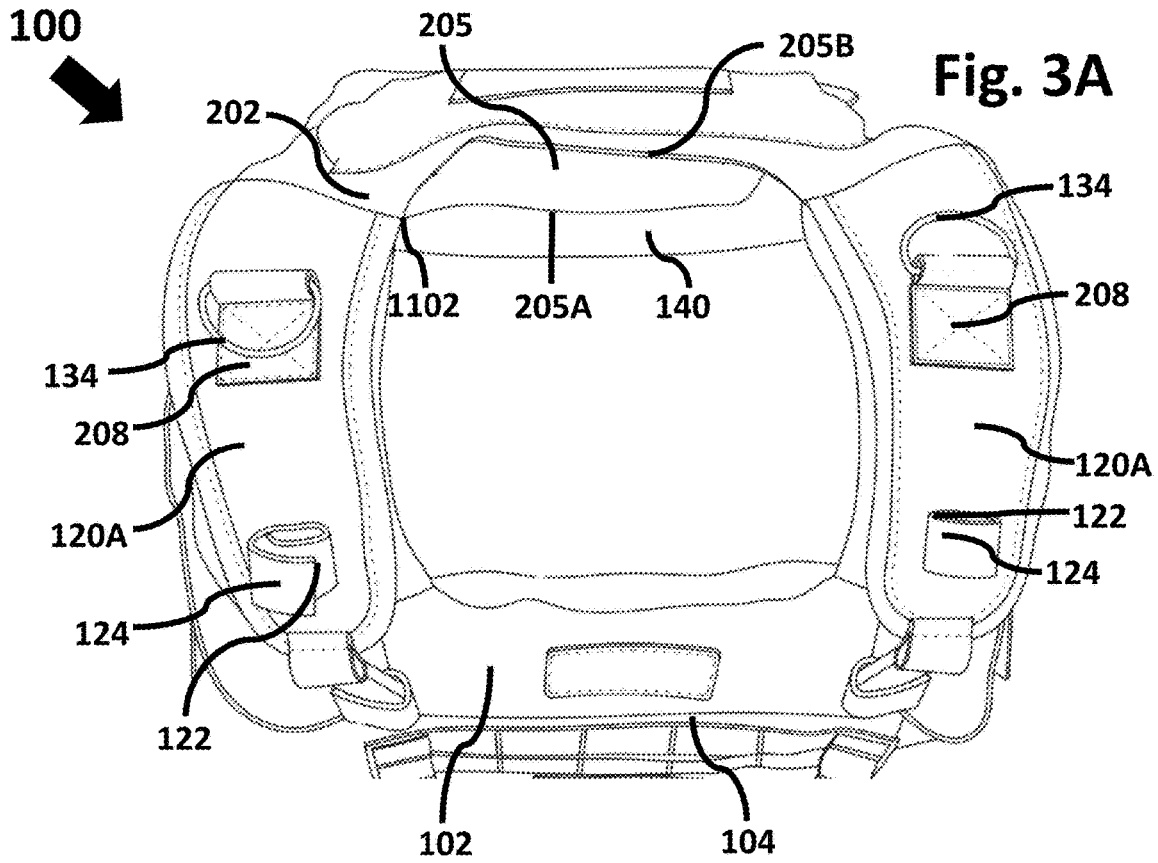
FIG. 3A is a top perspective view of the multi-functional vest with the rear compartment opened.

FIG. 3A illustrates a top perspective view of the vest in the assembled configuration, wherein the rear compartment 205 is secured to a periphery of the rear panel 202 wherein the rear panel 202 comprises a set of panels, distinct from the front panel 102 and the rear panel 202 of the multi-functional vest 100 wherein the set of panels of the rear top compartment 205 is understood as the inner surface(s) and the outer surface(s) of the rear panel 202. A first inner panel 205A of the rear panel compartment 205 comprises of an inner surface and an outer surface, a second inner panel 205B of the rear panel compartment 205 comprises of an inner surface and an outer surface, wherein the first inner panel 205A and the second inner panel 205B comprises of at least one closure mechanism such as a fastener, wherein the at least one fastener comprises of a first component and a second component. When the inner surfaces of the first panel 205A and the second panel 205B of the rear compartment 205 are engaged by the at least one fastener, the rear compartment 205 is closed and when the panels of the rear panel compartment 205 are disengaged by the at least one fastener, the rear panel compartment 205 is opened, revealing an enclosed space configured to secure one or more articles. It is understood the term enclosed is an enclosure of the rear compartment 205 for inserts to be secured to the rear compartment 205. In some embodiments, the rear compartment 205 may comprise of an additional panel distinct from the first panel 205A and the second panel 205B configured as a spacer. The additional panel outer surface comprises of a fastener configured to secure the rear top compartment 205 in particular the first panel 205A and second panel 205B.

Figure 3B:
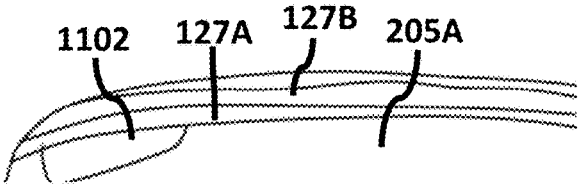
FIG. 3B is a front perspective view of the rear compartment closed by a fastener and a cavity on a periphery outer surface.

FIG. 3B illustrates the rear compartment 205 in particular the first inner panel 205B closed by a fastener which may comprise of a zipper, wherein the zipper comprises of two components, wherein a first component 127A is engaged with a second component 127B to define the rear top compartment 205 closed. It is understood at least one inner panel of the first panel 205A or the second panel 205B comprises of at least one component of either the first component 127A or the second component 127B configured to open and close the rear compartment 205.

The outer surface of the rear compartment comprises of a cavity 1102, wherein the cavity 1102 is understood as an aperture. The cavity 1102 is a strategically positioned to the hollow inner surface of the rear panel, to the outer surface of the rear panel 202, configured for attachments such as but not limiting to a hydration tube for passage way. In some embodiments, the hydration tube can be deployed from the periphery outer surface of the rear compartment 202 wherein the cavity 1102 is not utilized. The shape of the cavity 1102 is typically circular or oval, and in some instances a rectangle shape designed to allow the hydration tube to pass through without obstruction. The diameter of the hole is sized to snugly fit the tube while preventing excessive movement that could lead to wear or damage.

In some embodiments, the periphery surface of the cavity 1102 of the outer and/or inner surface is reinforced to prevent fraying and to enhance durability. This reinforcement can be achieved through stitching or the addition of a grommet, which provides a protective barrier around the hole. This feature is essential for maintaining the integrity of the vest, especially in high-stress areas where the tube may be frequently inserted and removed.

In some embodiments, the cavity 1102 is positioned near the outer surface of the top rear panel, positioned near rear compartment 205 opening. This position is an easy access to the hydration tube while ensuring that it does not interfere with the wearer's movements. The position is designed to optimize the flow of water from the bladder to the user, allowing for hands-free hydration during physical activities.

Figure 3C:
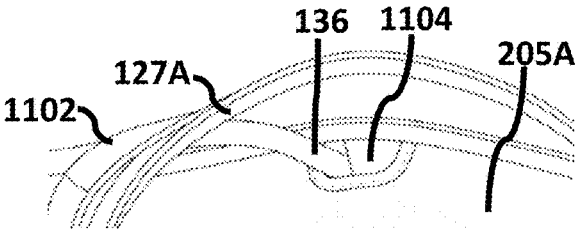
FIG. 3C is a front perspective view of the rear compartment opened revealing a hydration tube through a passageway from the inner surface to the outer surface of the second panel of the rear compartment.

FIG. 3C illustrates the rear compartment 205 opened by the zipper, revealing a hydration tube 136 and can be routed from the inner surface to the outer surface wherein the outer surface is referenced in FIG. 3B. It is better understood the opening is often referred to as a 'tube port,' is strategically positioned on the inner surface of the rear top compartment 205 to allow the hydration tube to exit easily. The tube port may feature a grommet or reinforced lining to prevent wear and tear from friction as the tube passes through. Additionally, the port can include a flap or cover to protect the interior of the compartment from external elements, such as dust or moisture.

Figure 3D:
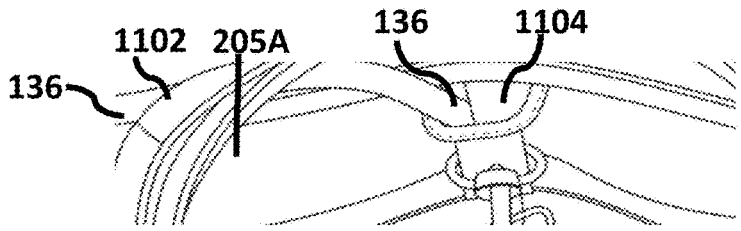
FIG. 3D is a front perspective view of the rear compartment opened revealing a hydration tube within the enclosure of the second rear panel compartment, wherein a hydration bladder is revealed in a compartment distinct from the second rear panel compartment, wherein the hydration tube is configured to pass through the inner surface to the outer surface of the rear compartment.

FIG. 3D illustrates a top portion of a hydration bladder inserted to a spacer within the rear compartment 205 wherein the hydration tube 136 is routed through the tube port 1104, secured along the vest using clips, loops, or guides, ensuring it remains accessible. This design is configured for easy drinking access for the user while keeping the tube securely in place.

For a method of preparation for the rear panel compartment 205 during pre, during and post manufacturing, the rear top compartment 205 is as explained, sew the outer fabric and lining together along the edges on a periphery surface leaving one side of the periphery open for the bladder insertion. Attach the closing mechanism such as the zipper with the two components and/or hook and loop fastener around the opening of the compartment to secure the hydration bladder, cut a hole in the upper section of the rear top compartment 205 spaced from the closing mechanism around the periphery surface, wherein the hole is a cavity and/or opening previously referenced.

In some embodiments, the tube 136 of the hydration bladder 135 is revealed comprising of the surrounding rear top compartment 205. It is to be understood the rear top opening 205 can be partially or completely sealed with or without articles in the enclosure. In other instances, the top of the rear panel 202 can comprise of a flexible fabric or waterproof coating, wherein the flexible fabric or waterproof coating is configured as a mouth to receive and secure articles or liquids in the enclosure. The inner fabric of the rear panel 202 can comprise of a fold over, wherein the fold over is configured to overlap to the outer surface opening of the rear panel 202, wherein the rear panel 202 outer surface opening comprises of spacers, wherein the spacer is lined from side to side. A top glider is then inserted from one side of the fold over, wherein the inner surface of the top glider comprises of empty sections, wherein the empty section is configured to attach and secure onto the spacers to insert or secure articles in the enclosure of the rear panel 202.

It is to be understood the hydration bladder 135 or similar bladders can be inserted to other compartments and panels in which may have similar features to receive a tube 136 previously listed.

In some embodiments, the multi-functional vest 100 comprises of an inner tab in one or more compartments or compartments, wherein the user can pull to inflate the multi-functional vest 100 during an emergency situation and/or to use as a leisure life jacket. It is to be understood the multi-functional vest 100 can be solely utilized as a life jacket without fixed components and/or accessories such as but not limiting too resistance bands, removable resistance bands and limb straps.

In some embodiments, the inner tab may be fixed to a compartment of the main body of the vest 100 via a reinforcement, wherein the hydration bladder 135 and hydration tube 136 is removable however does not interfere with the structure and usage of the inner tab when closed or opened. In some instances, the inner tab string can be hidden in a rear opening of the multi-functional vest with or without the hydration bladder 135. Also, the fastener 122 configured to close and open the rear opening can comprise of a waterproof zipper further comprising on a coating of the selected PVC, PU in combination thereof to protect all fixed and/or removable articles in the rear compartment enclosure. For example, the user can tuck the inner tab during dry land physical movement. It is to be understood the term dry land is a surface and underwater is in one or more layers of fluid.

The vest incorporates closed-cell foam as the primary buoyant material. This foam is selected for its lightweight, water-resistant properties, and high buoyancy. Alternative buoyant materials, such as inflatable bladders or buoyant beads, may also be used.

The vest includes multiple foam inserts placed in strategically located compartments. These inserts are made from closed-cell foam, which provides significant buoyancy and is resistant to water absorption. The foam inserts can be of varying thicknesses and densities, allowing for customization of buoyancy based on the user's weight and activity level.

In some embodiments, the vest may include inflatable bladders instead of, or in addition to, foam inserts. These bladders are equipped with adjustable air valves, allowing the user to increase or decrease buoyancy as needed. The bladders are made from durable, waterproof materials to ensure longevity and reliability.

Alternatively, the vest may contain compartments filled with buoyant beads or pellets. These beads are lightweight and provide buoyancy while allowing for easy adjustment of the amount of buoyant material.

The buoyant materials are housed in dedicated compartments distributed evenly throughout the vest. These compartments are designed to ensure a balanced distribution of buoyancy, preventing the vest from tilting or flipping in water.

With respect to the flotation feature, the multi-functional vest 100 panels comprise of fabric, particular Buoyancy materials selected from helium, cork, fiberglass, nylon, neoprene, elastic, Dyneema® and a layer of foam mesh pad 140 in combination thereof to use as a personal flotation device (PFD). During manufacturing, machinery can blend the listed materials to condense and compress the fabrics, configured to comprise of a comfortable layer. In some instances, the special machinery is not provided, one or more layers can be attached to one other by adhesive, glue, paint, stitching or a securing mechanism 208 comprising of a coating of hydraulic resistance and a closed-hole structure for long term load. In some instances, a less constructed multi-functional vest 100 can be manufactured, such as minimal compartments or compartments to provide the multi-functional vest 100 at a lighter weight, however with respect to the blended fabrics, a multi-functional vest can comprise of the features and more listed in this specification without losing the ability to float. Moreover, the fabrics mentioned is configured to bend and increases the flexibility. It is to be understood a personal flotation device comprises of minimal to no weight in the enclosure of the openings of the multi-functional vest. For underwater training, one or more weights can be inserted to the multi-functional vest compartments, panels or other openings or accessories attached to the MOLLE attachments configured to sink.

In some embodiments, the front panel 102 may comprise of additional layers relative to the rear panel 202 configured to turn an unconscious user to a face up position in a body of water. However, the panels can comprise of the similar or same number of layers. As previously mentioned, a multi-functional vest can be less structured configured for one purpose such as a personal flotation device (PFD). For example, a front compartment may not be constructed to a panel configured to float. However, a mesh compartment can be configured to the outer surface for articles. Without the compartment, a fastener 122 such as a hook and loop fastener or zipper is located on a panel 102, 108 or 202 configured for a quick a quick release. The fastener 122 can begin on the top of a panel 102 or 202 wherein the ending point is located to the bottom of the multi-functional vest 100. If the intended purpose is to utilize the multi-functional vest for a personal flotation device, a loop 134 on a panel may not be required.

FIG. 4A illustrates the vest in a top side perspective view with the outer surface compartments opened and the rear shoulder straps 120A that are integrally formed from the same continuous piece of fabric as the rear panel 205 itself, in other words the shoulder straps 120A are not separated component but attached to the rear panel 202 but are seamlessly integrated into the main body of the inner and outer fabric. This design choice eliminates the need for additional stitching or attachment points. With respect to the rear panel compartment 205, the lack of separate attachment points reduces the risk of the straps detaching from the panel under stress or heavy use. The continuous fabric construction distributes the load more evenly across the multi-functional vest 100, reducing strain on specific areas. The seamless integration of the rear shoulder straps 120A ensures a smooth transition between the straps and the rear panel 202, eliminating potential pressure points or discomfort that might arise from bulky seams or connectors. This design enhances the overall comfort for the user, especially during prolonged wear. The integrated design provides a cleaner, more streamlined appearance. It also simplifies the manufacturing process, as there are fewer components to assemble. Additionally, the lack of detachable parts reduces the risk of losing components during use or maintenance.

The shoulder straps of the rear panel 202 are designed to be adjustable via a fastener 122, allowing the vest to accommodate users of various sizes and body shapes. The adjustability is achieved through buckles or hook-and-loop fasteners, which are integrated into the rear shoulder straps 120A themselves. These fasteners allow users to easily customize the fit of the vest to their comfort and preference.

In some embodiments, a passage way in the enclosure of the rear top compartment 205 may pass between one or more layers of the rear shoulder strap 120A and a cavity to an outer surface of the rear shoulder strap 120A. For example, a hydration bladder or similar bladders are inserted to the rear top compartment 205 without a visibility with respect to the hidden passage way of the layers of the rear shoulder straps 120A. The term hidden passage way is to be understood as one or more inner fabric layers of the rear shoulder straps 120A. In some embodiments, the inner surface of the rear panel 202 comprises of a single cavity, similar to the cavity in the inner surface referenced and illustrated on FIG. 3B-3C.

It is understood this method is dependent on the way during pre, during or post manufacturing to allow a passage for a hydration bladder and tube. This method of manufacturing allows the rear compartment 205 fully closed. Depending the size of the multi-functional vest 100, a rear shoulder straps 120A can comprise of a metal, steel or similar dense wiring in the inner surface or outer surface of the rear shoulder strap 120A configured to create additional securing mechanism when adjusting.

FIG. 4B-C illustrates a set of fillable weights 400 and 402, wherein the set of fillable weights increases the weight resistance training. The filler weights 400, 402 can be retailed with or without the multi-functional vest for additional weight. The weight of each filler can vary with respect to different density of fillable materials and to the customized size of the vest. The fillers can be stacked on top or side by side around the enclosure of one or more compartments of the main body of the vest. In some embodiments, the filler weights 400 and 402 can be pre-filled with fillable materials. In some embodiments, the filler weights 402 and 402 provides at least one opening around the periphery of the outer surface and the enclosure, internal surface via hook and loop fastener. A filler weight 402 and 506 can comprise of the selected polyester, nylon, canvas in combination thereof. The interior is a mixture of at least one coating layer of polyvinyl chloride (PVC) and/or polyurethane (PU) for liquid proof providing optional alternatives for additional weight.

FIG. 5A illustrates the multi-functional vest comprising buckles 126 between the front panel 102 and the side panel 108, and a set of buckles 126 secured from the rear shoulder straps 120A extended over to the front shoulder straps 120B to define the main body as an assembled vest configuration 100. One or more layers of foam padding 140 with a spacer between the inner surface of the rear panel 202 is blended with the first layer of fabric, resulting in a minimal elevated surface while maintaining comfort.

In some embodiments, the periphery outer surface of the rear panel 202 comprises a loop 134 secured between the inner surface and the outer surface, configured for attachments such as straps for resistance training. In some embodiments, the panels 102, 202, 108 with compartments on the outer and/or inner surface comprise at least one MOLLE attachment 142 on the outer surface for cosmetic purposes and attachments.

The side panels 108 comprise an opening on the top and rear for weighted articles and resistance elements. The user can adjust the tightness of the side panel compartments 110 by pulling the fabric, which is looped around the loop of the buckle 126. The periphery of a compartment 104, 110 comprises loose fabric to expand with respect to the article in the enclosure. The opening of a compartment can comprise a fastener 122 selected from a zipper, hook and loop fastener, or adjustable working strap comprising a loop in combination thereof to receive an article.

The multi-functional vest 100 provides options for weight such as compartment weighted plates 400 and compartment filler weights 402 described and illustrated as an article. The shape of said weights is configured to fit in a compartment 104, 110 without damaging the enclosure. In some instances, a less constructed multi-functional vest 100 can comprise side compartments 104, 110 made of one or more layers of fabric selected from spandex, synthetic fibre, elastic, natural fibre, neoprene, foam padding, mesh, water proof coating in combination thereof.

One or more sizes of the multi-functional vest 100 can be retailed with respect to the user(s) request prior to manufacturing, wherein the compartment 104, 110 may comprise an adjustable working strap 128 either fixed in the enclosure of the pocket or on the outer surface of the side pocket to adjust the waist of the multi-functional vest 100 to the user's torso.

A compartment is formed to hold weight plates, positioned on the lower half of the inner surface of the rear panel 202. The compartment 106, 110 comprises a zippered and/or hook and loop fastener or snap opening along one or more periphery edges to allow inserting and removing articles such as weight plates.

FIG. 5B illustrates a panel 105, 110 comprising an opening via a compartment 106 with a fastener 122 configured to fold over and secure all articles in the enclosure. The compartment reinforcement 500 is secured to one side of the enclosure of the panel and comprises one or more layers of fabric.

In some embodiments, a compartment 106, 110 can comprise a compartment divider 501 configured to divide and separate articles in different sections of the compartments. This allows a user to place one or more weighted plates 504 or filler weights 506 in the enclosure and for another section to receive liquids or a removable hydration bladder.

FIG. 6A illustrates a user placing a rounded barbell weight plate to the front compartment 204 wherein the front compartment is a compartment secured to the outer surface of the front panel 104 comprising of an inner surface and an outer surface. In some embodiments, the front compartment 204 may comprise of durable material such as nylon, polyester, canvas, rubber in combination thereof to increase the durability and long last lasting.

In some embodiments, the opening access of the front compartment 204 is a closing mechanism such as a zipper, hook and loop fastener, buckle, adjustable working strap in combination thereof to securely hold the article in place without the article deploying. In some embodiments, the compartment 204 comprises of a set of panels, within a first panel is the outer surface of the compartment 204 wherein a second panel is the inner surface of the compartment 204 wherein the inner surface of the compartment is understood the outer surface of the front panel 102 to define an enclosure to temporarily secure a weight, wherein to open and close the compartment 204 one or more securing mechanism are secured to the periphery of the compartment 204. inner surface of the front compartment 204 comprises of one or more securing mechanism wherein the securing mechanism is secured to a surface within the enclosure of the compartment 204 configured to temporarily secure a weight in place. In some embodiments, the outer surface 204 comprises of a MOLLE attachment in a vertical and/or horizontal position.

In some embodiments, a periphery surface corner is rounded achieved by forming the corners with a small radius of curvature during manufacturing. This radius is sufficient to create a smooth, rounded appearance without significantly altering the overall dimensions or functionality of the front compartment 204. The slightly rounded corners provide a softer, more appealing look compared to sharp, square corners. This design element can be applied to a variety of articles such as standard barbell and metal plates.

In some embodiments, the compartment 204 is expandable and provides enhanced versatility and functionality compared to fixed-size compartments. When expanded, the compartment's volume and storage space is increased, allowing users to accommodate larger or additional items. When not in use, the compartment can be collapsed or retracted back to its original size for compact storage. In a visual detection, the periphery of the compartment 204 comprises a variety of materials selected from: one or more layers of fabric such as elastic stretchable materials, plastics, metals, or composites in combination thereof, depending on the intended application. The expansion mechanism is designed to be durable, reliable, and easy to operate.

The front compartment 204 may comprise of durable material such as nylon, polyester, canvas, rubber in combination thereof to increase the durability and long last lasting.

In some embodiments, the opening access of the front compartment 204 is a closing mechanism such as a zipper, hook and loop fastener, buckle, adjustable working strap in combination thereof to securely hold the article in place without the article deploying from the vest 100.

FIG. 6B illustrates the enclosed front perspective view of the front compartment 204 with a horizontal axis 204A and a vertical axis 204B. It is understood this figure illustrates the inner surface 204C of the front compartment 204 and is the outer surface of the front panel 104. This may be interpreted and understood as an additional compartment within the front compartment 204. For example, the front compartment 204 features may comprise of the same and/or similar features as the rear compartment 205 illustrated and referenced on FIG. 3A such as the first panel 502A and the second panel 205B configured to accommodate and secure a weight in the enclosure. In some instances, the front compartment 204 can be a single compartment.

In some embodiments, a set of weight straps 204D-G are secured and positioned in distinct sections in the front compartment 204. A first layer of fabric is secured to the internal surface 204C of the front compartment 204 of the vest. This first layer serves as a base for attaching the weight straps 204D-G and provides initial structural support. A second layer of fabric is positioned on top of the first layer. The base portion of the second layer is fixedly attached to the first layer to enhance durability and provide reinforcement. The second layer extends beyond the attachment area, forming two free ends that are not secured to the first layer. This design allows for adjustability and secure closure of the internal compartment 204.

In some embodiments, at least one of the free ends of the second fabric layer incorporates a fastening mechanism 122. This may include of the selected a hook-type fastener for quick and secure attachment and/or an adjustable fastener system 122 to accommodate varying loads and provide customizable tension. It is understood the fastening mechanism are adjustable with respect to the fastener component.

In some embodiments, the fastener ladder which may be attached to the opposing weight strap 204D-G internal surface 204C or integrated into the vest structure, provides multiple attachment points for the free ends, allowing for variable positioning and tension adjustment of the weight straps 204D-G.

This multi-layered weight strap 204D-G assembly design enhances the durability and functionality of the weight strap 204D-G system, providing a robust method for restraining and organizing contents within the vest, in particular the front compartment 204.

In some embodiments, one or more securing mechanism such as a ladder portion of the hook 602 may be secured on one end of fabric strap in the inner surface of the front compartment 204B wherein the opposite end secured to the inner surface 204C near to an inner surface periphery to temporarily secure a weight within the inner surface of the front compartment 204. It is understood the hook and ladder is defined as a single fastener 602 to accommodate to the dimensions of the article by firmly pulling the fabric of one or more weight straps 204D-G.

In some embodiments, the weight strap 204D-G securing system comprises one or more weight straps oriented along horizontal axes 204B and vertical axes 204A. For example, a horizontal weight strap 204D weight's circumference or perimeter and comprises of durable fabric further comprising of fasteners for tightening and preventing lateral movement and shifting.

In some embodiments, one or more weight straps, in particular weight strap 204F-G may be oriented and slightly positioned and slanted vertically over the top of the weight, when a weight is placed within the enclosure of the front compartment 204. The vertical weight straps run from one side of the weight to the other, crossing over the top wherein are secured to opposite sides in the internal surface 204C.

In some embodiments, one or more articles are secured within the compartment 204 and 504 wherein with respect to the flexibility of the compartment fabrics. When an object, such as a weight, is placed inside the compartment and the object is smaller than the full capacity of the compartment, the user can pull the straps to adjust the compartment size. As the straps are tightened, the fabric of the compartment is drawn inward, reducing the overall internal volume of the compartment. This adjustment ensures that the object inside is securely held in place, preventing it from shifting or moving during transport or use. Once the desired level of contraction is achieved, the straps can be secured using locking mechanisms such as buckles, hooks, or friction locks, which hold the straps in their tightened position.

FIGS. 7-10 illustrates fixed and/or removable resistance bands 600 deployed from compartments around the vest 100.

In some embodiments, the resistance bands 600, bungee cords, and slings includes elastic tension used for physical activities and in some cases physical therapy. The resistance bands 600 are elongated strips or tubes of elastomeric material, typically constructed from the selected natural latex rubber, rubber or synthetic alternatives such as thermoplastic elastomers, plastic, carbon fibre in combination thereof. The resistance bands 600 are characterized by variable resistance levels with the ability to stretch to several times their original length, flat or tubular cross-sectional positions and resistance forces In some embodiments, a resistance band 600 comprises of elastic cords wherein the inner core of rubber strands, featuring a cylindrical shape with diameters with hooks or other attachment mechanisms at one or both ends. It is understood resistance bands and slings are flexible, load-bearing straps or bands, which may be elastic or non-elastic, designed to support or suspend objects. The resistance bands 600 are characterized by construction from materials such as nylon, polyester, or elastomeric compounds in combination thereof. The base including endless loops, flat web slings, or round slings, and optional reinforcement with internal webbing or external wear pads, fasteners and hooks 602.

In some embodiments, one or more resistance band 600 comprises of a protected covering such as at least one layer of durable material configured to prevent damage and wear and tear to the resistance band 600 itself.

FIG. 7A comprises of two resistance bands 600 deployed from a real panel 202 wherein the length of the resistance bands 600 is decreased in length and dimensions relative to resistance bands 600 on the front and rear panel compartments 106 and 206. With respect to the position of the compartment 207 on the rear panel 202, the intended use is configured for upper body workouts such as push-ups, wherein a longer length resistance band 600 is not required however for manufacturing and retailing purposes, all fixed and/or removable resistance bands 600 may be the same length.

In some embodiments, one or more resistance bands 600 are fixed within a compartment, in particular the compartments 106 and 206 configured to release when the compartments are opened via a closing mechanism. Previously referenced on FIG. 5A-B, the compartments may comprise of dividers and spacers in the enclosure to prevent damage when other articles are in the enclosure of the compartments and also dividers to neatly stow away the resistance bands 600 not interfering with other articles. such as the These compartments are constructed with reinforced stitching to withstand tension and equipped with secure closures to retain the resistance bands when not in use. The distal ends of each resistance band feature durable clasps or hooks for secure attachment and adjustable straps or cuffs designed to fit around the user's arms or legs. A network of reinforced fabrics or loops is integrated into the multi-functional vest 100, allowing the bands to be guided from the compartments to optimal exit points on the vest, directed to minimize interference with the user's range of motion, and easily accessible for quick attachment to limbs, wherein a user can wear a limb strap 604 as illustrated on FIG. 7B. The resistance band 600 and limb straps 604 includes multiple anchor points on the vest for customizable resistance angles, interchangeable bands of varying resistances within each compartment, and length adjusters on each resistance band 600 to modify tension and accommodate different body sizes.

With respect to the fixed resistance bands 600 within compartments on the vest 100, a detachable resistance band 604 as depicted on FIG. 7C can be utilized with one or more limb straps 604 wherein a hook 602 on the detachable resistance band can be attached and secured to a loop 134 wherein a user's one or more limbs can be secured in the limb strap 604 such as a user's ankles for lateral exercises. It is understood the detachable resistance band 606 may comprise of the elements of the fixed resistance band 600 however the first end and the second end of the detachable resistance band is freely. The inner surface of the resistance band portion may comprise of additional resistance band layers for maximum expansion, preventing the possibility of wear and tear. The closure mechanism of the limb straps 604 can comprise of at least one fastener 122, wherein the at least one fastener is selected from a hook and loop fastener, buckle, adjustable working strap ladder, ladder in combination thereof. At least one layer of compressed lining is around the surface and the periphery of the limb strap 604 comprises of compressed lining and binding.

FIG. 8 illustrates a front side perspective view of the vest with a total of four resistance band 600 on the bottom opening of the compartments and a single resistance band 600 released from the rear panel compartment 207 wherein each resistance band 600 includes a limb strap on the attaching point via a hook 134. The fixed resistant band 600 in one or more compartments comprises of a one or more layers of a fabric strap, a securing mechanism in particular a ladder configured to receive and the fabric strap by folding over itself between one or more dividers on the ladder 128 and the resistant band 600 with a covering. It is understood each resistance band 600 comprises of two ends, a first end is secured to a surface of one or more panels and a second end, opposite to the first end is freely. The fabric strap 130 can be stitched and/or fixed to the inner surface of a compartment of one or more panels of the vest 100. For additional reinforcement, the stitching base of the first end comprises of a single box shape and/or x shape and in some instances the box shaped and x shape for additional reinforcement. The resistance band can fold over itself to be stowed away in a compartment, wherein when the compartment is closed by a securing mechanism, the resistance band 600 may not have a non-visual detection and in some instances, the resistance band 600 or working components to the structure of the resistance band 600 provide a slight visual detection, depending on the angle looked upon.

FIG. 9 illustrates a bottom perspective view of the assembled vest configuration 100 and a compartment 206 of the rear panel 202 wherein two resistance bands 600 are disposed. It is understood the opening of the compartment 206 may comprise of dividers to create a separation of the resistance bands and other articles when secured to the compartment 206. The divider may comprise of two ends. In one instance, a first end may be secured and fixed to an inner surface of the rear panel 202 and a second end of the divider may move freely. For additional reinforcement, both ends of the divider can be fixed to the inner surface of the rear panel 202 creating distinct sections for separation of one or more articles.

FIG. 10 illustrates the vest in the disassembled configuration 101 in particular the front panel 102 detached and not shown in the illustration. Resistance bands 600 are disposed from the compartments and limb straps 600 on the end point of each resistance band 600. When disassembled 101, the vest can generally flat upon a surface or in some instances with a slight elevation with respect to the compressed lining and additional fabric and components such as articles within the compartments.

FIG. 11-12 illustrates an assembled closed vest 100 configuration configured to a disassembled vest configuration 103. FIG. 11A illustrates a front perspective view of the vest in the assembled closed configuration 100 with the front panel 102 secured with the side panels 108.

FIG. 11B illustrates the front panel flap 1000 detached from two side panels 108 via a fastener 122 wherein a fastener of the front panel flap 1000 comprises of a hook and loop fastener or similar securing mechanism and fasteners 122. One side of the hook and loop fastener is secured to the inner surface of the front panel flap 1000 and the opposite side of the hook and loop fastener is secured to the two side panel flaps 108A-B. In some embodiments, the front panel 202 outer surface comprises of a fastener 122, wherein the fastener is the opposite side of the hook and loop fastener of the front panel flap 1000 configured to engage with each other, with or without the side panel flaps 108A-B. In some embodiments, the first end and/or second end of the side panel flap 108A-B is illustrated as a hexagon, however depending on the manufacturing method, the side panel flaps 108A-B can comprise of a thicker, dense shape or a narrow shape and in some instances, the side panel flaps 108A-B can be viewed and understood as a waist strap.

FIG. 11C illustrates a first side panel flap 108A comprising of a hook and loop fastener 122 detached from outer surface of the front panel 102. It is understood when the front panel flap 1000 is disengaged from the outer surface of the front panel 102, in particular the outer surface portion of the front panel 102 comprises of the opposite side of the hook and loop front panel flap 1000 to engaged with each other. It is understood the first side panel flap 108A comprises of a hook and loop fastener on the outer and inner surface, wherein the outer surface of the front panel 102 comprises of a hook and loop fastener, wherein the inner surface of the first side panel flap 108A comprises of the opposite side of the hook and loop fastener 122 relative to the outer surface of the front panel 102 to engage and temporarily secure with the side panel 108 hook and loop fastener. Furthermore, it is understood the side panel flaps 108 comprises of two ends, wherein each ends are detachable allowing a user to conveniently assemble and disassemble the vest. For interpretation purposes, a first side panel flap is defined as 108A and the second side panel flap is defined as 108B throughout the figures.

The inner surface of the mid-section of the side panel 108 includes a compartment 114 wherein the compartment comprises of a top flap to open and close via a hook and loop fastener 122 by conveniently pulling by grasping a loop wherein the loop comprises of one or more layers of fabric, wherein the loop 134 is configured for a user to quickly grasp the side panel 108 without discomfort when pulling directly onto the side panel flap 108A. It is understood at least one loop 134 can be secured to the inner surface and/or outer surface of the front panel flap 1000. In some embodiments, the loop 134 comprises of fabric stitching from the inner surface to the outer surface of the side panel flap 108A-B secured by a layer of securing mechanism or other securing mechanisms 208. In some instances, the loop 134 comprises of metal, wherein a layer of securing mechanism 208 is secured on top or under. It is to be understood the loops 134 illustrate on FIG. 10B-10C can fold on top or under the side panel flap 108A-B, wherein the loop is a connection 134. The loop 134 can comprise of the similar or same loops 134 loops of the rear shoulder strap 120A, however, the loops 134 can be secured around the outer surface or the periphery of the side panel flap 108A-B. The loop 134 may be manufactured as a is a D-ring or an oval or as a general receiving hole. In some instances, a loop 134 can be secured from the top of the side panel flap 108A-B to the bottom of the side panel 108 configured for a larger loop or grip. Additionally, this provides the user with additional attachments. For example, a top front panel flap 1000 may not be manufactured, wherein the two side panel flaps 108A-B are configured to attach onto the front panel 102, secured by a fastener 122 wherein the fastener 122 may comprise of a hook and loop fastener. Depending on the amount of space in between the two side panel flaps 108A-B, the loop 134 of the one or more ending of side panel flaps 108A-B can be configured as a grip or for attachments. With respect to the loop on outer periphery surface of the front panel flap 1000 and side panel flap 108A-B, a user can utilize the loop 134 as attachments for resistance training and physical activities.

FIG. 12A illustrates the rear perspective view of the rear panel 202 and the side panels 108 engaged with each other wherein the front panel 102 is disengaged and not shown.

FIG. 12B illustrates the rear panel 104 comprising of a set of rear flaps, wherein a first rear panel flap 1100 which can be interpreted as the inner surface of the rear panel compartment 204 wherein the inner surface of the first rear panel flap 204 comprises of a hook and loop fastener 122. In some embodiments, a layer of fabric between the top opening of the rear compartment 204 and a space between the hook and loop fastener 122 of the first rear panel flap 1100 to the opposite side of the opening of the rear compartment 204 configured for detaching from the rear panel 202. A user can firmly pull the bottom of the rear panel 202 such as a loop 134 on the periphery surface, in more particular the bottom of the rear compartment 204 to allow the user to unfold the second rear panel flap 1101 which can be interpreted as the bottom rear panel flap 1101. It is understood the outer surface and the inner surface of the second rear panel flap 1101 comprises of a fastener on each surface, wherein the fastener 122 is a hook and loop fastener. Once the first rear panel flap 1100 and the second rear panel flap 1101 are detached, in other words disengaged with each other, a set of MOLLE attachments 142 are revealed wherein the set of MOLLE attachments 142 comprises of at least one row from a vertical to vertical position, horizontal to horizontal position and in some instances a vertical to horizontal position. When in a assembled vest configuration 100 for a transition to a disassembled vest configuration 103 can user can detach a set of hooks 1004 wherein the hooks 1004 are on one ending of the panel, in particular the first side panel 108A from the MOLLE attachments 142 on each end of the vest 100. The MOLLE attachment 142 and the side panel hook 1004 are configured to securely attach and also, to adjust the size of the user. For example, a user with a smaller torso, a second end of the side panel 108B hook 1004 and may be secure to a MOLLE attachment 142 near the center point of the rear panel and a user with a larger torso, the hooks 1004 of the side panel can attach to the MOLLE attachments 142 near the periphery surface of the rear panel 202. This method decreases the length of the side panels extending to the front panel 102 to the front panel 102. This adjustable feature allows users with various body proportion to utilize a single vest eliminating multiple purchases of various size vests.

An example for a method of preparation from FIG. 11A-12B, 13A-B the vest assembled configuration 100 to a disassembled vest configuration 103 wherein a user would firmly pull the loop 134 on the bottom periphery surface of the front panel compartment 104 wherein the inner surface of the front compartment 104 comprises a hook and loop fastener 122 revealing a first end of each side panel 108A as illustrated on FIG. 12B wherein the outer surface of the first end of the side panel 108A comprises of the opposite side of the hook and loop fastener of the inner surface of the front compartment 104, wherein the user would firmly grasp and pull the loop 134 on each side panel 108 in particular the first end of the side panel 108A to move freely, wherein the inner surface of the first end side panel 108A comprises of a hook and loop fastener, wherein the outer surface of the front panel 102 comprises of the opposite side of the hook and loop fastener of the inner surface of the first end side panel 108A, wherein two rear shoulder straps 120A are firmly pulled to disengage from the set of the front shoulder straps 120B via a fastener 122 wherein the inner surface of the rear panel shoulder strap 120A comprises of a fastener such as a hook and loop fastener and/or female side of a buckle, wherein the outer surface of the front shoulder straps 120B is configured to be detached and disengaged with the rear two shoulder straps 120A wherein the front panel 102 is detached from the main body of the vest as illustrated on FIG. 12A-B, wherein the rear compartment 204 is lifted by pulling a loop 134 on the periphery surface of the rear compartment 204 and/or rear panel 202 revealing the inner surface of the rear compartment 204 comprises of the opposite side of the hook and loop fastener relative the outer surface of the top rear panel flap 1100 such as a hook and loop fastener 122 wherein the periphery of the top surface of the second rear panel flap 1101 is secured to the near the bottom periphery surface of the rear panel 102 wherein when the top rear panel flap 1100 is disengaged with the bottom rear panel flap 1101 is disengaged and may lay partially flap upon a surface, wherein the outer surface of the rear panel 202 comprises of a set of MOLLE attachments 142, the user can detach the hooks 1004 of the second ending of the side panel 108B wherein when both side panels 108 are disengaged with each other, the vest assembly disassembles in four distinct panels.

It is understood the side panels 108 on FIGS. 1-12 comprises of a set of hooks 1004 on the second end of the side panel 108B to adjust to a user's body proportion, a set of compartments on the outer surface and the inner surface configured to hold one or more articles. FIG. 13-14 may be configured to adjust in length via a securing mechanism such as a fastener from the front panel to the rear panel configured to adjust to the body proportion and may not comprise of other components such as a compartment, however the intended purpose to adjust to the user's body. The structure of the side panels 108A-B and the set of shoulder straps 120A-B illustrate on FIG. 13-14 will be explained in greater detail.

FIG. 13 illustrates the front panel 102 and the rear panel 202 engaged with each other via the set of rear shoulder straps 108A and the front shoulder straps 108B and the side panels 108 detached from the main body of the vest and is partially or completely flat upon a surface. A first end of the front shoulder straps 120B are fixed to the periphery surface of the front panel 102 wherein the front shoulder strap 120B comprises of elastic material, compressed lining, mesh in combination thereof. The front panel shoulder straps 120B are elongated in other words, stretchable and extendable and comprises of a set of fasteners such as a hook and loop fastener on the outer surface and/or inner surface.

In some embodiments, the rear panel 202 comprises of a fastener 122 wherein the fastener is a ladder 122A comprising of a set of dividers. A layer of fabric is secured from the top periphery of the rear panel 202 to loop around a first divider and secured via stitching, adhesive and similar securing mechanism to securely hold the ladder 122A in place, wherein the fabric of the ladder 122A creating flexibility to move freely.

In some embodiments, the mid-section of the shoulder straps 120B comprises of a set of shoulder flaps 121 wherein the outer surface comprises of a set of MOLLE attachments 142 configured to secure one or more accessories such as a hydration tube. The shoulder strap flap 121 comprises of a set of end points, wherein a first ending and a second ending of the set of endings comprises of a hook and loop fastener on the inner surface each ending configured to engaged with each other, wherein the front shoulder strap 120B comprises of a set of securing mechanism such as fasteners 122 wherein the fastener is a hook and loop fastener 122 on each end. At least one shoulder strap 120B is pulled through a portion of the ladder wherein the ending of the at least one shoulder strap 120B is pulled through a second ladder divider 122A. Depending on the user's body proportion, excessive length in a shoulder strap 120B may be secured to the outer surface of the MOLLE attachments 142 of the front panel 102.

In some embodiments, each side panel endings 108A-B comprises of a fastener 122 such as a hook and loop fastener wherein the mid-section of the side panel 108 comprises of fabric layers such as elastic, compressed lining, expandable materials in combination thereof designed for comfort and the ability to accommodate to a user's body proportion in the assembled vest configuration 100.

In some embodiments, the outer surface of the front panel 102 and the rear panel 202 comprises of a set of MOLLE attachments 142 wherein the MOLLE attachment outer surface comprises of a side of a hook and loop fastener configured to receive attachments and accessories with the opposite side of the hook and loop fastener of the outer surface of the MOLLE attachments 142.

In some embodiments, the inner surface of at least one end of the side panel 108A-B is fixed and secured to the outer surface of the rear panel 202 and/or front panel 102 wherein when the at least one ending of the side panel 108A or 108B is configured to wrap around the main body of the vest, in particular to the outer surface of the front panel 102 to the outer surface of the rear panel 202 and vice versa and in some instances, overlapping and engaging to the inner surface of one rear panel ending 108A and/or 108B depending on the length when expanded.

FIG. 14 illustrates the vest in the disassembled configuration 103 wherein the front panel 102 and the rear panel 202 are stacked on top of each other, a side panel 108 is wrapped around a top vertical direction to the bottom direction, wherein the inner surface of the side panel comprises of a hook and loop fastener 122 wherein the hook and loop fastener 122 is engaged and attaches to the outer surface of the front panel 102 and/or rear panel 202 and a second side panel 108 is wrapped around a horizontal side direction, wherein the inner surface of the side panel 108 comprises of a hook and loop fastener 122 to engage and attach onto shoulder strap 120B. With respect to the elastic material of the side panel 108, the side panel can expand in length and width to firmly hold the two panels together. For a quick release, a user can firmly pull the loop 134 on an ending of the side panel 108.

FIG. 14B illustrates a side perspective of the assembled vest configuration 100 wherein the vest is generally flat or partially upon a surface which makes it convenient for travelers with tight capacity in luggage's. Depending on the articles placed within the vest assembly, an expansion may have a visual detection depending on the perspective view looked upon such as the rear panel 202 and front panel 102 wherein the side panels 108 firmly holds the main body together.

FIG. 15A illustrates a cavity 1102 on the bottom near a periphery surface of the rear panel 202 wherein an inlet port 137A positioned and secured on top or directly onto the cavity 1102 wherein the inlet port 137A is strategically located to avoid interference with adjacent components such as side panels 108A minimizing the risk of damage during use. In some embodiments, the one or more MOLLE attachment 142 can be secured overtop of the inlet port for coverage and protection, wherein the inlet port is positioned on a side angle ensuring the tube remains in place during movement, avoiding interference with a user during physical activities. The position allows other components such as side panels 108A, components and attachments to secured directly overtop the one or more MOLLE attachment 142 protecting the inlet port. In addition, this position is a quick release snap to insert or detach the filter or tube. This port may be equipped with a secure, leak-proof cap 1102 or closure mechanism.

The filter 137 is an integral part of the rear panel 202 serving as the connection point between the enclosure of the rear panel 202 to the hydration tube 136, In addition, a filter 137 as depicted on FIG. 15B may be temporarily secured to the inlet port 137A to the outer surface of the rear panel 202, typically near the bottom or side for optimal fluid flow.

In some embodiments the filter 137 is designed to securely attach to the outer surface of the rear panel 202, ensuring a tight, leak-proof connection. This may be achieved through various mechanisms such as threading, snapping, or a friction-fit.

The connection point at the inlet port 137A to the filter 137 hold may include a valve or sealing mechanism that prevents fluid leakage when the tube is not attached. This ensures that fluids are only dispensed when the spout tube is properly connected.

The spout, which is connected to the cavity 1102, may incorporate a distinct inline filter. Both filters are designed to remove impurities, bacteria, and other contaminants from the fluid as it passes through the tube 136, ensuring that the user consumes clean, safe water.

The filter can be housed within the spout itself or may be attached directly to the tube 143. In either configuration, the filter 137 is positioned to ensure that all fluids passing from the bladder through the tube are properly filtered.

The filter 137 may be replaceable or built-in, depending on the design. For example, FIG. 15A illustrates three hydration component alternatives to either be distinct or combined. A first feature is a hydration bladder secured to the rear compartment 205 of the rear compartment 205 wherein the tube 136 is released from the inner surface to the outer surface of the rear panel 202 wherein the tube is secured by a fastener on the outer surface of the shoulder strap 120A. A second alternative is a hydration closure on the rear compartment 205 wherein fluids are inserted directly to the enclosure, between the inner surface and the outer surface of the rear panel 205 wherein the hydration tube 136 wherein the hydration tube 136 is released via a cavity 1102 to the outer surface of the rear shoulder strap 120A. A third alternative is a cavity 1102 on the outer surface of the rear panel 202 wherein the cavity 1102 is secured by a hydration cap 139, wherein when released and disengaged from the outer surface of the rear panel 202, fluids are inserted directly through the cavity 1102 positioned inwards from the opposite side inner surface of the hydration cap 139 wherein the filter 137 is secured to the inlet port 137A wherein the tube 136 is secured and is inserted to the filter 137 and the tube 136 is passed through the outer surface of the rear panel 205 and in some instances, a set of securing mechanisms are secured to the outer periphery surface of the rear panel 202 and secured to the shoulder strap 120A by an additional fastener. FIG. 15A illustrates the hydration cap 139 positioned on the upper portion of the rear panel 202 however in some instances, the hydration cap 139 can be placed between the periphery outer surface and/or inner surface. Also, to maximize the rear panel compartment 205 the hydration cap can be positioned closer to the top periphery of the outer surface of the rear panel 202. In some embodiments, the hydration cap 139 comprises of a fastener wherein the fastener comprises of two ends, a first end secured to the outer surface of the rear panel and/or hydration cap lining, and a second end secured to the inner surface of the hydration cap, wherein the fastener comprises of the selected a strip of fabric, plastic, rubber, carbon fibre in combination thereof. The fastener secured between the outer surface of the rear panel 202 and/or hydration cap lining and the inner surface of the hydration cap is to hold the hydration cap from deploying once unfastened from outer surface of the rear panel 202. This feature allows a user to add fluids to the enclosure of the rear panel 202 without holding the hydration cap, ensuring the hydration cap will not deploy from the multi-functional vest 100. It is understood the three alternatives may be combined or as distinct features however still maintain the hydration purposes during physical activities. The three alternatives demonstrate a method of preparation steps. In the replaceable version, the filter 137 is conveniently detached and replaced without the need for tools, allowing the user to maintain the filter's effectiveness over time. It is understood the tube 136 may be secured directly to the inlet port 137A when a filter 137 is not necessary such as clean fluids are available; the filter is not necessary and the hydration tube can be secured to the inlet port 137A with respect to the measurements.

In some embodiments, the tube 136 is a flexible conduit that transports fluid from the hydration bladder and/or the enclosure of the rear panel 202 to the mouthpiece. It is made from a durable, kink-resistant material that allows for easy bending and manipulation without compromising the flow of fluids. The tube 136 is connected at one end to the inlet port 137A and/or filter 137, which in turn is attached to the bladder and/or enclosure of the rear panel 202 via the spout tube hold. At the opposite end, the tube connects to the mouthpiece 138, providing the user with easy access to the filtered fluid. The mouthpiece 138 is securely attached to the spout tube, typically using a friction fit, locking mechanism, or quick-connect coupling. This attachment ensures that the mouthpiece 138 remains securely in place during use, preventing leaks or disconnections. This allows the user to insert the articles within the rear panel wherein fluids are in a separate compartment while, preventing the articles and fluids having direct contact with each other.

In other instances, an inlet port 137 is secured to the inner surface of a panel 102, 108, 202, wherein a sleeve comprising a layer of fabric is secured along the periphery of the inner surface of the panel to either pass onto the outer surface or the inner surface between the first and second layer of the rear shoulder strap configured to release from a rear shoulder strap and secured to the stabilizer. To prevent possible irritation during physical movement, a layer of padding can overlap the first layer of fabric of the sleeve.

It is understood the rear panel 202 comprises of two compartments 106, 205 wherein each compartment may include weights directly to the enclosure of each compartment 106, 205 wherein when the multi-functional vest 100 is used for physical activities with fluids in the rear panel and/or rear compartment 205 an additional compartment 106 can still retain weights with respect to the dividers between the two distinctive compartments 106, 205 configured for a separation of each compartment. For example, a hiker can retain weights within the compartment 106 to maintain fluids within the second compartment 205.

In some embodiments, the rear compartment 205 is designed with a reversible feature, enabling the inner surface to be pulled out and transitioned to become the outer surface of the rear panel. To achieve the reversible transition between the rear panel outer surface to a rear panel inner surface, the rear panel may comprise of a pull tabs, straps, loops, grips in combination thereof. The inner surface of the rear panel compartment 205, 106 is equipped with pull tabs or straps strategically positioned near the opening. A user can grasp and pull the inner surface outward, initiating the reversal process. In some embodiments, the inner surface is made from a flexible, durable material that can be conveniently flip inside out without compromising the integrity of the panel. This material may include fabrics like nylon, polyester, water-proof coating in combination thereof or similar textiles with reversible components. In some embodiments, the seams connecting the inner surface to the rear panel compartment 205 are designed to allow for smooth transition between the rear panel 202 outer surface transitioned to the inner surface. This may include reinforced stitching or specialized seam construction to prevent tearing during the transition. When liquids are deployed from the enclosure of the rear panel inner surface(s) 205 the reversible feature may be configured to cleanse the enclosure to prevent any forming bacteria. It is understood the shoulder straps(s) can be manufactured as one piece of each panel, wherein the shoulder strap(s) comprises of seamless integration of the shoulder straps 120A ensures a smooth transition between the straps and the rear panel 202, eliminating potential pressure points or discomfort that might arise from bulky seams or connectors, as referenced in FIG. 4A.

The set of shoulder straps 120A of the rear panel 202 are integrally formed as part of the rear panel 202 in other words the shoulder straps and the rear panels are a single, continuous piece of material. This configuration eliminates the need to manufacture a separate element, enabling the rear panel and the set of shoulder straps 120A to be seamless. This method of manufacturing is better understood as depicted on FIG. 4A, wherein the vertical axes of the shoulder straps 1500 to the horizontal axes 1504 illustrating the set of shoulder straps 120A seamless. With respect to the seamless shoulder straps 120A the inner surface of the shoulder strap shares the inner surface of the rear panel 202 wherein the entire rear panel can be revertsed inside out through one or more apertures, in particular one or more compartments 205, 106 and the hydration cap 139 when disengaged with the rear panel outer surface.

In some embodiments, the inner surface of the rear panel 202 may comprise of compartments, MOLLE attachments, loops and elements on the outer surface of the rear panel, wherein when reversed, the inner surface components are revealed during the transition between the rear panel inner surface to the outer surface configuration.

In some embodiments, the rear panel 202 can be configured into multiple configurations during a transition between the outer surface reversed to the inner surface, wherein the outer surface is interpreted as the closed bag configuration 100 wherein when the inner surface is reversed to the outer surface, it is understood as an open configuration 101 wherein between the transition between the inner surface and the outer surface of the rear panel 202, wherein when inner surface of the rear panel 202 is pulled through midway through an aperture, in particular the hydration cap and/or rear compartment 205 the configuration is between understood dual facing configuration (not shown).

In some embodiments, the closure mechanism, such as a zipper, hook-and-loop fastener, or snap buttons in combination thereof may be integrated along the periphery surface or directly to the outer surface of the rear compartment 205 to secure the reversed surface once the transition is complete. This ensures that the compartment remains stable in its new configuration. During the transition, the user pulls the inner surface outward using the pull tabs, straps, grips, loops in combination thereof. The flexible material allows the surface to invert, and the guide channels ensure a smooth process. Once fully reversed, the closure mechanism secures the surface in place, making the inner surface now the outer surface of the rear panel.

The rear compartment 205 of the rear panel is strategically positioned and designed to receive the inversion of the front panel into the rear panel's internal cavity, in other words the enclosure of the rear panel 202. When the vest is not in use or when compact storage is required, the front panel can be flipped inside through the top opening and stored within the enclosure of the rear panel 202, resulting in a compact configuration, in other words the inner surface of the rear panel is reversible to be converted to the outer surface by passing through one or more aperture, wherein the aperture is a compartment, cavity and/or other openings throughout the front panel and the rear panel of the multi-functional vest.

Multiple advantages of a reversible panel in particular the rear panel such a cleaning and drying when not in use. The ability to reverse the inner surface to the outer surface provides cleaning methods such as washing the entire inner surface reducing the chances of grime accumulation, bacteria, mold and other build ups. When washing the multi-functional vest 100, reversing inside out can enable the durability with respect to identifying any potential weak points or damage wherein a user can secure such damage, if any. Additionally, ice cubs can be inserted due to the wide opening when reversed making a more convenience usage.

Runners, hikers and campers may not have the convenience of clean water however the multi-functional vest 100 with a built-in hydration system and the reversible features, hydration filter and tube, the user(s) can fill polluted water directly into the inner surface of the rear panel, securing the closure mechanism in particular the hydration cap 139, connecting the hydration tube to the inlet for hydration purposes. It is preferred the fill line is below the hydration cap 139 eliminating the possibility of fluids to leak through. This provides convenience and also reduces plastic in particular one time use water bottles.

It is understood FIG. 15A-15B illustrates the rear panel 202, however in the cavity receiving fluids can be configured to the front panel 102 or in some instances, this feature can comprise on both panels, depending on the request of a user.

This feature allows is economical in which an additional removable hydration bladder is not required. It be understood the rear top compartment 205 can comprise of dividers, wherein a divider comprises of a layer of fabric stitched to the enclosure (not shown) configured to separate the hydration bladder 135 and also to provide optional articles.

In some instances, the enclosure of a panel can comprise of an opening from to allow fluids to pass through one or more shoulders straps 120. For example, a panel such as the rear panel can comprise of a hallow enclosure comprising of minimal layers between the inner and outer fabric allowing fluids to fill the rear panel and the rear shoulder strap in particular the horizontal axes 1504 of the rear panel 202. This can also provide additional comfort and weight to the vest.

The multi-functional vest 100 design can be adapted into a simplified harness configuration while retaining core functionality. This harness variant maintains essential components and preserves the intended purpose of the original vest design.

In some embodiments, the outer surface of the multi-functional vest 100 may comprise of a layer of fixed or removable solar reflective tape (not shown) configured to create visibility during the night.

In some embodiments, a layer of the multi-functional vest may comprise of solar panels (not shown) configured to the outer surface of one or more panels of the multi-functional vest. It is understood the term solar panels pockets may comprise of inserts to attach and detach the solar panel, depending on the usage of the multi-functional vest. The outer surface of a panel may comprise of the solar panel via a solar panel pocket, wherein the inner surface of the panel can comprise a small lining for a cable to a compartment or compartment to charge phones or any outlet sources. The solar panels can comprise of flexible silicon and a water proof coating to allow a user to allow a liquid on the multi-functional vest without damage. With respect to the layers of the panels of the multi-functional vest, the solar panels and cords will not cause any damage to the working parts or discomfort to the user. During the day, the multi-functional vest can be left out in the sun to store energy. During movement in the night, the multi-functional vest can restore the energy. It is to be understood during the flotation usage of the multi-functional vest, the solar panels can still remain charged without damage which allows the user to request for assistance in an emergency situation. Prior to manufacturing, a user can request customized pockets around a panel of the multi-functional vest to carry specific articles in various sizes. Dividers are provided in between the solar panels configured to separate one another and to prevent damage to another solar panel, similar to a compartment divider 501. It is to be understood the solar panels are not only designed for charging devices but designed and manufactured for other natural energy purposes. This green technology feature reduces carbon footprint (importing and exporting electronic devices), which also encourages a user to stay active in the outdoors.

It is understood the panels, compartments and cavities each comprise of an opening, wherein the term aperture substituted in some embodiments within the specifications of this invention.

FIG. 16 illustrates a harness 1600, wherein the harness is a less constructed multi-functional vest for the similar intended purposes. FIG. 16A illustrates the harness configured with fasteners 122 secured to one another which is considered a closed harness configuration. FIG. 16B illustrates a harness 1600 comprising of resistance bands deployed from one or more compartments (not shown) on the lower waist belt. It is to be understood the resistance bands 600 of the multi-functional vest comprises of the similar or same structure of the resistance bands 600 and detachable resistance bands 606 on the harness. In some embodiments, a resistance band 600 is configured to deployed from a compartment on the upper shoulder outer surface comprising of a limb strap for resistance training such as push-ups. In some embodiments, a detachable resistance band 606 is attached via a hook 602 to a loop of the waist strap of the harness 1600.

FIG. 16A-B may comprise of the components illustrated on FIG. 7-10 in particular, a set of loops 134 fasteners 122, a set of securing mechanisms 208, resistance bands 600 hooks 602, limb straps 604. However, the waist strap around the harness 1600 comprises of a buckle 126 and a second buckle 1600 on the upper portion of the harness 1600 which can be interpreted as the fasteners on the outer surface of the front panel 102 illustrated throughout FIG. 1-15.

It is to be understood that the machinery in manufacturing can be configured with the capability to blend fabrics and coating, upon the user's request. The blend of the fabrics and the associated coating can incorporate any of cotton, leather, polyester, synthetic blends, or any other material that would be suitable to be utilized as a vest. The coating can be selected from one or more coatings that are waterproof, protect from dirt, or a protectant that allows for longevity in quality.

The features, components and functions described above, as well as alternatives may be combined into many other different systems and/or applications. Various alternatives, modifications, variations or improvements may be made by those skilled in the art, each of which is also intended to be encompassed by the disclosed embodiments.

It is understood that all references to particular materials and dimensions are provided to detail example embodiments, and may not define the composition and dimensions of all embodiments.

While various embodiments in accordance with the principles disclosed herein have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

It will be understood that the principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

Additionally, the section headings herein are provided as organizational cues. These headings shall not limit or characterize the invention(s) set out in any claims that may issue from this disclosure. Specifically, and by way of example, although the headings refer to a "Field" such claims should not be limited by the language under this heading to describe the so-called technical field.

Further, a description of technology in the "Background" section is not to be construed as an admission that technology is prior art to any invention(s) in this disclosure. Neither is the "Brief Summary" to be considered a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, if the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, un-recited elements or method steps.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least +1, 2, 3, 4, 5, 6, 7, 10, 12 or 15%.

The term "or combinations thereof" as used herein refers to all permutations and combinations of the listed items preceding the term. For example, "A, B, C, or combinations thereof is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims.

What is claimed is:

1. A multi-functional vest comprising:

a main body, the main body including:

a front panel, the front panel comprising:

an inner surface;

an outer surface; and at least one compartment;

a set of side panels; and a rear panel, the rear panel comprising:

an inner surface and an outer surface;

a set of compartments, wherein the set of compartments includes:

a first compartment positioned between the inner surface and the outer surface of the rear panel; and at least one fastener positioned within the first compartment, the at least one fastener comprising:

a first component; and a second component;

wherein when the first component and the second component of the at least one fastener are disengaged with each other, the first compartment of the rear panel is configurable to secure a removable hydration bladder;

wherein the first compartment of the rear panel comprises a cavity opening extending between the inner surface and the outer surface of the rear panel;

wherein the removable hydration bladder includes a removable hydration tube configured to extend through the cavity opening of the rear panel; and wherein, when a weight is secured in a second compartment of the set of compartments, the cavity opening of the first compartment and the hydration tube extending therethrough remain accessible to a user during physical activities.

2. The multi-functional vest of claim 1, wherein the rear panel of the main body further comprises the second compartment, wherein the second compartment further comprises at least one weight strap, wherein the first compartment and the second compartment of the rear panel are spaced apart from each other.

3. The multi-functional vest of claim 2, wherein a divider is positioned on the inner surface of the rear panel, wherein the divider separates the first compartment and the second compartment of the rear panel, wherein the removable hydration bladder is secured to the first compartment of the rear panel and the second compartment of the rear panel is configured to temporarily secure one or more accessories, wherein at least one accessory of the one or more accessories is a weighted plate.

4. The multi-functional vest of claim 1, further comprising a set of fasteners, wherein the set of fasteners comprises:

a first fastener of the set of fasteners secured to the outer surface of the front panel of the main body; and a second fastener of the set of fasteners secured to the outer surface of the rear panel of the main body.

5. The multi-functional vest of claim 1, wherein the at least one compartment of the front panel comprises a weight strap, wherein the weight strap is secured to an inner surface of the at least one compartment of the front panel of the main body to temporarily secure a weight.

6. The multi-functional vest of claim 1, wherein the set of side panels of the main body comprises:

a first side panel, and a second side panel, wherein each side panel includes:

a first end; and a second end;

wherein the first end of each side panel comprises a fastener secured to an outer surface; and wherein the second end of each side panel comprises a fastener secured to the outer surface of the rear panel of the main body.

7. The multi-functional vest of claim 6, wherein when the fastener of the first side panel and the fastener of the second side panel are engaged with a front panel fastener the main body is defined as having an assembled vest configuration.

8. The multi-functional vest of claim 7, wherein when the set of side panels of the main body are disengaged from the front panel fastener of the main body, the main body is defined as having a disassembled vest configuration, where each panel is configured to generally lie flat upon a surface.

9. The multi-functional vest of claim 1, further comprising one or more sets of shoulder straps, wherein the one or more sets of shoulder straps comprises:

a first set of shoulder straps, wherein the first set of shoulder straps comprises a fastener secured to an outer surface of the first set of shoulder straps, and a second set of shoulder straps comprising a fastener secured to an inner surface of the second set of shoulder straps.

10. A multi-functional vest comprising:

a main body, the main body including:

a front panel, the front panel comprising:

an inner surface;

an outer surface; and at least one compartment;

a set of side panels; and a rear panel, the rear panel comprising:

an inner surface and an outer surface;

a set of compartments, the set of compartments including:

a first compartment positioned between the inner surface and the outer surface of the rear panel, the first compartment positioned on an upper portion of the rear panel;

a second compartment positioned between the inner surface and the outer surface of the rear panel, the second compartment positioned on a lower portion of the rear panel; and at least one fastener positioned within the first compartment, the at least one fastener comprising:

a first component; and a second component;

wherein when the first component and the second component of the at least one fastener are disengaged with each other, the first compartment of the rear panel is configurable to secure a removable hydration bladder;

wherein the first compartment of the set of compartments of the rear panel comprises a cavity opening extending between the inner surface and the outer surface of the rear panel; and wherein, when a weight is secured in the second compartment of the set of compartments of the rear panel, the cavity opening of the first compartment and a removable hydration tube of the removable hydration bladder extending therethrough remain accessible to a user during physical activities.

11. The multi-functional vest of claim 10, wherein the second compartment of the set of compartments of the rear panel comprises at least one weight strap, wherein the at least one weight strap is secured to an inner surface of the second compartment.

12. The multi-functional vest of claim 11, wherein a divider is positioned on the inner surface of the rear panel, wherein the divider is configured to separate the first compartment and the second compartment of the set of compartments of the rear panel, wherein the removable hydration bladder is secured to the first compartment of the set of compartments and a weight is temporarily secured to the second compartment of the set of compartments of the rear panel.

13. The multi-functional vest of claim 10, wherein an inner surface of at least one compartment of the set of compartments of the rear panel comprises water-proof coating.

14. The multi-functional vest of claim 10, further comprising one or more sets of shoulder straps, wherein a first set of shoulder straps of the one or more sets of shoulder straps is secured to the front panel of the main body, wherein a second set of shoulder straps of the one or more sets of shoulder straps is secured to the rear panel of the main body, wherein at least one shoulder strap of the second set of shoulder straps comprises a loop, wherein the loop is configured to secure the removable hydration tube when passed through the cavity opening of the rear panel of the main body.

15. The multi-functional vest of claim 10, wherein the outer surface of the front panel comprises at least one MOLLE attachment, wherein the at least one MOLLE attachment is configured to temporarily secure one or more accessories.

16. The multi-functional vest of claim 10, wherein a compartment of the front panel comprises at least one weight strap, wherein the at least one weight strap is adjustable via a fastener.

17. A multi-functional vest comprising:

a main body, the main body including:

a front panel, the front panel comprising:

an inner surface;

an outer surface; and at least one compartment;

a set of side panels; and a rear panel, the rear panel comprising:

an inner surface and an outer surface;

a set of compartments, the set of compartments including:

a first compartment positioned between the inner surface and the outer surface of the rear panel, the first compartment positioned on an upper portion of the rear panel;

a second compartment positioned between the inner surface and the outer surface of the rear panel, the second compartment positioned on a lower portion of the rear panel; and at least one fastener positioned within the first compartment of the set of compartments, the at least one fastener comprising:

a first component; and a second component;

wherein when the first component and the second component are disengaged, the first compartment of the set of compartments is configurable to secure a removable hydration bladder;

wherein the first compartment of the set of compartments comprises a cavity opening extending between the inner surface and the outer surface of the rear panel;

wherein the second compartment of the set of compartments comprises a weight strap;

wherein a divider is positioned on the inner surface of the rear panel and is configured to separate the first compartment and the second compartment of the set of compartments of the rear panel; and wherein the removable hydration bladder includes a removable hydration tube configured to extend through the cavity opening of the rear panel.

18. The multi-functional vest of claim 17, wherein the outer surface of the front panel comprises at least one MOLLE attachment, wherein the at least one MOLLE attachment is configured to temporarily secure one or more accessories.

19. The multi-functional vest of claim 17, wherein the at least one compartment of the front panel further comprises at least one weight strap, wherein the at least one weight strap is adjustable via a fastener.

20. The multi-functional vest of claim 17, further comprising one or more sets of shoulder straps, wherein the one or more sets of shoulder straps comprises:

a first set of shoulder straps, wherein the first set of shoulder straps of the one or more sets of shoulder straps comprises a fastener secured to an outer surface of the first set of shoulder straps, the first set of shoulder straps secured to the front panel of the main body; and a second set of shoulder straps, wherein the second set of shoulder straps of the one or more sets of shoulder straps comprises a fastener secured to an outer surface of the second set of shoulder straps, the second set of shoulder straps secured to the rear panel of the main body.

* * * * *